US006053248A

United States Patent [19]

Ross

[11] Patent Number: 6,053,248

[45] Date of Patent: Apr. 25, 2000

[54] METHODS OF COMPLETING WELLS UTILIZING WELLBORE EQUIPMENT POSITIONING APPARATUS

[75] Inventor: Colby M. Ross, Carrollton, Tex.

[73] Assignee: Halliburton Energy Services, Inc., Dallas, Tex.

[21] Appl. No.: 09/304,937

[22] Filed: May 4, 1999

Related U.S. Application Data

[62] Division of application No. 08/712,821, Sep. 12, 1996, Pat. No. 5,954,133.

[51] Int. Cl.[7] ..... E21B 33/124; E21B 43/116

[52] U.S. Cl. ..... 166/297; 166/313; 166/387

[58] Field of Search ..... 166/119, 127, 166/191, 242.7, 313, 387, 297

[56] References Cited

U.S. PATENT DOCUMENTS

| | | | |
|---|---|---|---|
| 2,716,456 | 8/1955 | Brown | 166/119 |
| 3,032,108 | 5/1962 | Bielstein | 175/4.52 |
| 3,100,535 | 8/1963 | Bielstein | 166/191 |
| 3,115,187 | 12/1963 | Brown | 166/313 |
| 5,178,219 | 1/1993 | Striech et al. | 166/289 |
| 5,373,899 | 12/1994 | Dore et al. | 166/278 |

*Primary Examiner*—Hoang Dang

*Attorney, Agent, or Firm*—Paul I. Herman; Marlin R. Smith

[57] ABSTRACT

Methods of completing wells utilizing wellbore equipment positioning apparatus provide repositioning of sand control screens and perforating guns without requiring movement of a packer in the wellbore. In a preferred embodiment, a well completion method includes the steps of lowering a packer, positioning device, sand control screen, and perforating gun into a well, perforating a zone intersected by the wellbore, expanding the positioning device, and positioning the sand control screen opposite the perforated zone.

16 Claims, 21 Drawing Sheets

METHODS OF COMPLETING WELLS UTILIZING WELLBORE EQUIPMENT POSITIONING APPARATUS

CROSS-REFERENCE TO RELATED APPLICATION

This is a division of application Ser. No. 08/712,821, filed Sep. 12, 1996, now U.S. Pat. No. 5,954,133 such prior application being incorporated by reference herein in its entirety.

This application is related to a copending application filed on even date herewith entitled "WELLBORE EQUIPMENT POSITIONING APPARATUS AND ASSOCIATED METHODS OF COMPLETING WELLL", Ser. No. 08/712,758, and having Karluf Hagen, Colby M. Ross, Ralph H. Echols, and Andrew Penno as inventors thereof. The copending application is incorporated herein by this reference.

BACKGROUND OF THE INVENTION

The present invention relates generally to methods of completing subterranean wells, and, in a preferred embodiment thereof, more particularly provides a method which facilitates the placement of sand control screens and perforating guns opposite formations in the wells.

In the course of completing an oil and/or gas well, it is common practice to run a string of protective casing into the wellbore and then to run production tubing inside the casing. At the wellsite, the casing is perforated across one or more production zones to allow production fluids to enter the casing bore. During production of the formation fluid, formation sand is also swept into the flow path. The formation sand is typically relatively fine sand that tends to erode production equipment in the flow path.

One or more sand screens are typically installed in the flow path between the production tubing and the perforated casing. A packer is customarily set above the sand screen to seal off the annulus in the zone where production fluids flow into the production tubing. In the past, it was usual practice to install the sand screens in the well after the well had been perforated and the guns either removed from the wellbore or dropped to the bottom of the well.

Well completion methods continue to utilize time and resources more efficiently by running the guns, sand screens, and packer into the well on the production tubing in only one trip into the well. From the end of the production tubing down, the completion tool string typically consists of a releasable packer (one capable of being set, released, and reset in the casing, whether by mechanical or hydraulic means), sand control screens, and perforating guns. The completion string is lowered into the well until the guns are opposite the formation to be produced, the packer is set to seal off the annulus above the packer from the formation to be produced, the guns are fired to perforate the casing, the packer is unset, the completion string is again lowered until the sand screens are opposite the perforated casing, the packer is reset, and the formation fluids are then produced from the formation, through the sand screens, into the production tubing, and thence to the surface.

This method has several disadvantages, however. One disadvantage is that a significant amount of rig time is consumed while unsetting, repositioning, and resetting the packer. The rig operator must typically lift the production tubing, manipulate the tubing to unset the packer, lower the tubing into the well a predetermined distance, manipulate the tubing to set the packer, apply tubing weight to the packer, and, finally, perform tests to determine whether the packer has been properly set.

Another disadvantage of the method is that the above-described packer unsetting, repositioning, and resetting must be performed after the casing has been perforated. A necessary consequence of this situation is the possibility that formation fluids may enter the wellbore, and in an extreme situation may even cause loss of control of the well. For this reason, during the packer unsetting, repositioning, and resetting, the well is overbalanced at the formation during these operations—meaning that the pressure in the wellbore is maintained at a level greater than the pressure in the formation. This, in turn, means that wellbore fluids enter the formation through the perforations in the casing, possibly causing damage to the formation.

Furthermore, the method suffers from problems encountered when attempting to reset a packer. In general, modern releasable packers are fairly reliable when lowered into a wellbore and set in casing at a particular location. When, however, a releasable packer is set and then unset and moved to another location, its reliability is greatly diminished. The slips (which grip the interior wall of the casing) may no longer hold fast, and the packer rubbers (which seal against the casing) may not seal adequately a second time.

Additionally, there are other circumstances where, in the drilling, completion, rework, etc. of a well, it is necessary to reposition equipment in the well. Frequently, in these circumstances, it is inconvenient to reposition the equipment by manipulating tubing at the surface, repositioning a packer, or by other methods heretofore known. As an example, in modern practice it is common to run more than one set of perforating guns into a well in one trip. The guns are typically spaced apart with tubing such that each set of guns is positioned opposite a separate formation or pay zone before the guns are fired. If the guns could be repositioned after a first set of guns were fired into a formation, so that a subsequent set of guns would be positioned opposite another formation, the tubing used to space apart the guns could be eliminated and the production string could be shortened.

From the foregoing, it can be seen that it would be quite desirable to provide well completion methods which do not require repositioning a releasable packer, but which permit sand control screens to be run into the well with perforating guns in one trip and then position the sand control screens opposite the formation after the casing has been perforated. It is accordingly an object of the present invention to provide such well completion methods.

In addition, it is desirable to provide methods for positioning other equipment in a wellbore. It is accordingly another object of the present invention to provide such methods of positioning equipment in a wellbore.

SUMMARY OF THE INVENTION

In carrying out the principles of the present invention, in accordance with embodiments thereof, well completion methods are provided which permit displacing equipment within a wellbore, utilization of which do not require the user to reposition a packer or manipulate tubing. In broad terms, methods of axially displacing sand screens, perforating guns, and other equipment relative to a zone intersected by the wellbore are provided.

A first embodiment of the present invention provides a method of displacing a perforating gun in the wellbore, so that multiple zones may be perforated without the need to unset and reset the packer. The method includes the steps of providing multiple perforating guns and a positioning device configured in an axially compressed configuration. The perforating guns are then attached to the positioning device and inserted into the wellbore.

A first perforating gun is positioned in the wellbore opposite a first zone and the gun is fired to perforate the first zone. The positioning device is then extended, thereby axially displacing a second perforating gun within the wellbore and positioning the second gun opposite a second zone. The second gun is then fired to perforate the second zone.

A second embodiment of the present invention provides a method of isolating a zone in a wellbore, after the zone has been perforated. This is achieved by displacing a packer in the wellbore relative to the perforated zone. The method includes the steps of providing a first packer, a positioning device in an axially compressed configuration thereof, a second packer, and a perforating gun. The positioning device is attached between the first and second packers and the perforating gun is attached to the second packer. The packers, positioning device, and perforating gun are then inserted into the wellbore.

The perforating gun is positioned in the wellbore opposite the zone and the first packer is set in the wellbore. The gun is then fired to perforate the zone. The positioning device is extended, displacing the second packer in the wellbore such that the first and second packers straddle the perforated zone. The second packer is then set in the wellbore. The perforated zone may then be tested or injected with fracturing, acidizing, or gravel packing fluids, etc., while being isolated from the remainder of the wellbore.

A third embodiment of the present invention provides a method of utilizing a positioning device to perform multiple functions, such as carrying a sand control screen, functioning as a valve to selectively permit flow through the screen, and displacing a perforating gun in the wellbore. The method includes the steps of providing the positioning device which has first and second coaxially disposed tubular members, the second tubular member radially overlapping the first tubular member and having a perforation extending radially therethrough, and the first tubular member having a seal disposed on an outer side surface which sealingly engages the second tubular member. The seal isolates the first tubular member from fluid communication with the perforation.

The method also includes providing a packer, a perforating gun, and a screen, which is attached to the second tubular member adjacent the perforation. The packer, positioning device, screen, and perforating gun are then assembled into a tool string and positioned within the wellbore with the gun opposite the zone. The packer is set and the gun is fired to perforate the zone.

The positioning device is then extended such that the seal is displaced axially and permits fluid communication between the wellbore and the first tubular member through the screen. This allows fluids to flow from the perforated zone, through the screen, and into the tool string. Extension of the positioning device also displaces the screen in the wellbore so that it is opposite the perforated zone.

A fourth embodiment of the present invention also utilizes a positioning device with an attached sand control screen. In this method, a second positioning device is placed inside the first positioning device. The second positioning device functions as a washpipe when both of the positioning devices are extended.

The method includes the steps of providing inner and outer positioning devices, attaching the outer positioning device to the inner positioning device, disposing the positioning devices within the wellbore, extending the outer positioning device, and then extending the inner positioning device within the outer positioning device.

A packer and perforating gun may also be provided and attached to the inner and outer positioning devices before they are run into the wellbore. With the packer and perforating gun attached to the inner and outer positioning devices, the perforating gun is positioned opposite the zone, the packer is set, and the perforating gun is fired to perforate the zone. Then, when the inner and outer positioning devices are extended, the perforating gun is displaced in the wellbore and the screen is positioned opposite the perforated zone.

The use of the disclosed methods will permit rig time to be used more efficiently, which permits wellsite operations to be performed more economically. Additionally, the invention adds to the inventory of methods currently available for positioning equipment in a wellbore.

DETAILED DESCRIPTION

Figure 1A:
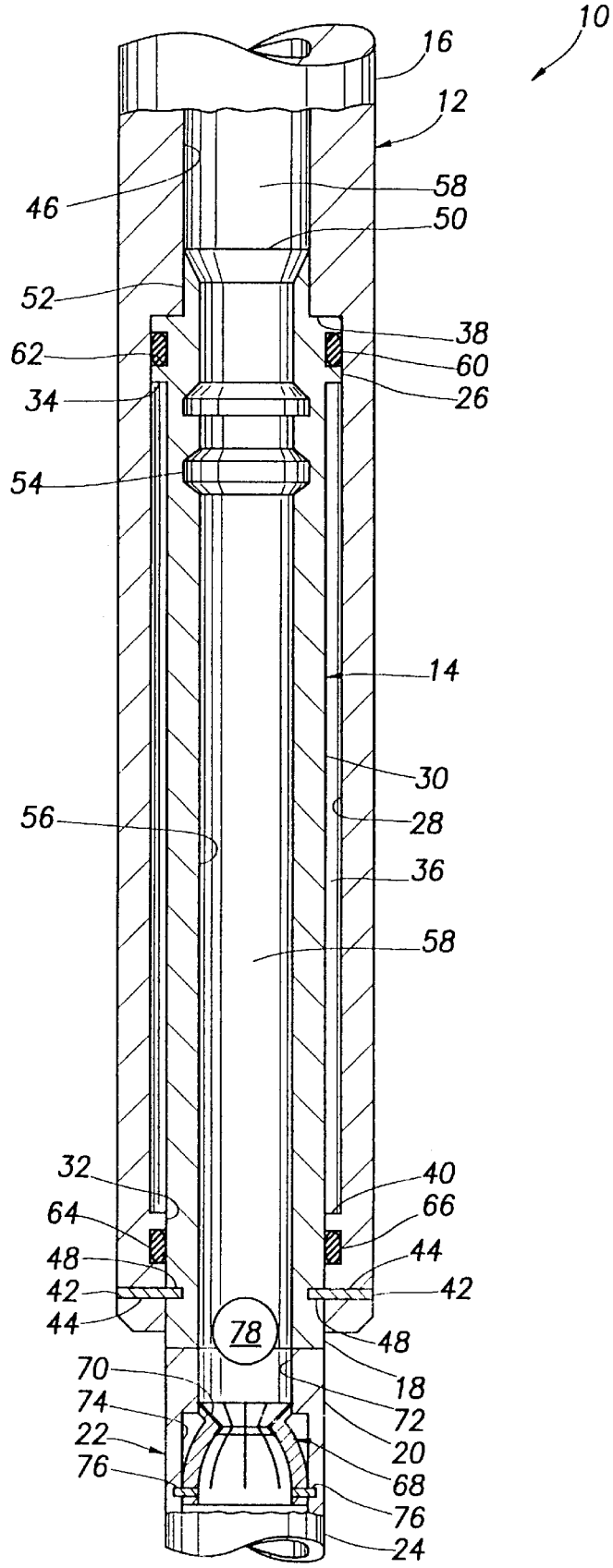
FIG. 1A is a schematicized partially cross-sectional view of a wellbore equipment positioning apparatus embodying principles of the present invention in a compressed configuration thereof.

Throughout the following description of the present invention shown in various embodiments in the accompanying figures, the upward direction shall be used to indicate a direction toward the top of the drawing page and the downward direction shall be used to indicate a direction toward the bottom of the drawing page. It is to be understood, however, that the present invention in each of its embodiments is operative whether oriented vertically or horizontally, or inclined in relation to a horizontal or vertical axis.

Illustrated in FIG. 1A is a wellbore equipment positioning apparatus 10 which embodies principles of the present invention. As will become apparent to those having ordinary skill in the art from consideration of the following detailed description and accompanying drawings, the apparatus 10 may be utilized for positioning various types of equipment in a subterranean wellbore. The equipment may include items such as perforating guns, sand screens, packers, etc. The following description and drawings of the apparatus 10, and others described herein embodying principles of the present invention, are not intended to and do not circumscribe the uses thereof contemplated by the applicant.

The apparatus 10 includes coaxial telescoping inner and outer tubular members 14 and 12, respectively. In a preferred manner of using the apparatus 10, an end portion 16 of outer tubular member 12 is sealingly attached to a packer (not shown in FIG. 1A) or other means of securing the end portion 16 against axial displacement in the wellbore. End portion 18 of inner tubular member 14 is sealingly attached to an outer housing 20 of a conventional ball catcher 22, an end portion 24 of which is attached to an item of equipment (not shown in FIG. 1A). In this manner, the apparatus 10, disposed between the packer and the equipment, is capable of displacing the equipment axially within the wellbore relative to the packer.

As representatively illustrated in FIG. 1A, inner and outer tubular members 12 and 14 are coaxial and overlapping in relationship to each other in a telescoping fashion. Radially enlarged outer diameter 26 on inner tubular member 14 is slightly smaller in diameter than polished inner diameter 28 of outer tubular member 12, and polished outer diameter 30 of inner tubular member 14 is slightly smaller than radially reduced inner diameter 32 of outer tubular member 12. This allows radially enlarged portion 34 of inner tubular member 14 to travel longitudinally in an annular space 36 bounded radially by inner diameter 28 and outer diameter 18 and longitudinally by radially extending internal shoulders 38 and 40 of outer tubular member 12.

Shear pins 42, each installed in a radially extending hole 44 formed through the outer tubular member 12 and extending into radially extending hole 48 formed radially into the inner tubular member 14, maintain the overlapping, axially compressed, relationship of the inner and outer tubular members, thereby securing against axial movement of one relative to the other. The number of shear pins 42 is selected so that a predetermined force is necessary to shear the pins and permit inner tubular member 14 to move axially relative to outer tubular member 12. A conventional latch profile 54 is formed in an interior bore 56 of inner tubular member 14 so that a conventional latch member, such as a slickline shifting tool, may latch onto the inner tubular member if necessary, for purposes described further hereinbelow.

Interior bore 56 of inner tubular member 14 and internal diameter 46 of outer tubular member 12 form a continuous internal flow passage 58 from end portion 16 to end portion 24 of the apparatus 10. To isolate the interior flow passage 58 from any exterior fluids and pressures, seal 60 is disposed in a circumferential groove 62 on the radially enlarged diameter 26. The seal 60 sealingly contacts the polished inner diameter 28 of outer tubular member 12, and will continue to provide sealing contact therewith if inner tubular member 14 is displaced axially relative to outer tubular member 12. A debris seal 64, disposed in a circumferential groove 66 formed on radially reduced inner diameter 32, is operative to prevent debris from entering the annular space 36, but allows fluid and pressure communication between the annular space and the wellbore external to the apparatus 10.

Ball catcher 22, as noted above, is of conventional construction and includes a fingered inner sleeve 68. An upper portion of the fingered inner sleeve 68 is radially compressed into a radially reduced inner diameter 72 of outer housing 20 and has a ball seat 70 disposed thereon. Ball seat 70 is specially designed to sealingly engage a ball 78. In a radially enlarged inner diameter 74, the fingered inner sleeve 68 is secured against axial movement relative to outer housing 20 by shear pins 76 extending radially through the fingered inner sleeve and partially into the outer housing. In the configuration representatively illustrated in FIG. 1A, the radially compressed fingered inner sleeve ball seat 70 has an inner diameter smaller than the diameter of the ball 78.

When the ball 78 engages the ball seat 70, forming a fluid and pressure seal therewith, pressure may be applied to the interior flow passage 58 above the ball to create a pressure differential across the ball, and a resulting downward biasing force, to shear the shear pins 76 and permit the fingered inner sleeve 68 to move axially downward relative to the outer housing 20. If the fingered inner sleeve 68 moves a sufficient distance axially downward as viewed in FIG. 1A, the radially compressed ball seat 70 will enter the radially enlarged inner diameter 74 of the outer housing 20 and expand so that its inner diameter will be larger than that of the ball 78. When this occurs, the ball 78 is permitted to pass through the ball catcher 22 and is therefore no longer sealingly engaged with the ball seat 70.

It will be readily apparent to one skilled in the art that if the pressure applied to the interior flow passage 58 is greater than the pressure existing external to the apparatus 10, a resulting downwardly biased axial force will also be applied to the inner tubular member 14. If the resulting force applied to the inner tubular member 14 exceeds the predetermined force selected to shear the shear pins 42 securing the inner tubular member 14 against axial movement relative to the outer tubular member 12, the shear pins 42 will shear and the resulting force will cause the inner tubular member 14 to move axially downward as viewed in FIG. 1A relative to the outer tubular member 12 until the enlarged portion 34 of the inner tubular member strikes the internal shoulder 40 of the outer tubular member. This is a preferred method of extending the inner tubular member 14 from within the outer tubular member 12 (decreasing the length of each which overlaps the other), so that the distance from the end portion 16 of the outer tubular member 12 to the end portion 24 of the ball catcher 22 is thereby enlarged.

In order for the apparatus 10 to be properly configured for operation according to the above described preferred method, the predetermined force necessary to shear the shear pins 42 securing the inner tubular member 14 against axial movement relative to the outer tubular member 12 must correspond to a pressure applied to the interior flow passage 58 above the ball 78 which is less than the pressure required to shear the shear pins 76 securing the fingered inner sleeve 68 against axial movement relative to the outer housing 20.

If a circumstance should occur wherein it is not possible to extend the apparatus 10 by applying pressure to the interior flow passage 58 to shear the shear pins 42, the shear pins 42 may alternatively be sheared by latching a conventional shifting tool into the latch profile 54 and applying the predetermined force downward on the inner tubular member 14. Such a circumstance may occur, for example, when debris prevents the sealing engagement of the ball 78 with the ball seat 70.

For purposes which will become apparent upon consideration of the written description accompanying FIGS. 13A–13C and 14A–14B, outer tubular member 12 may alternatively be perforated such that fluid communication is established between flow passage 58 and the wellbore after inner tubular member 14 is axially extended. Such perforation of outer tubular member 12 should preferably be below the seal 60.

Figure 1B:
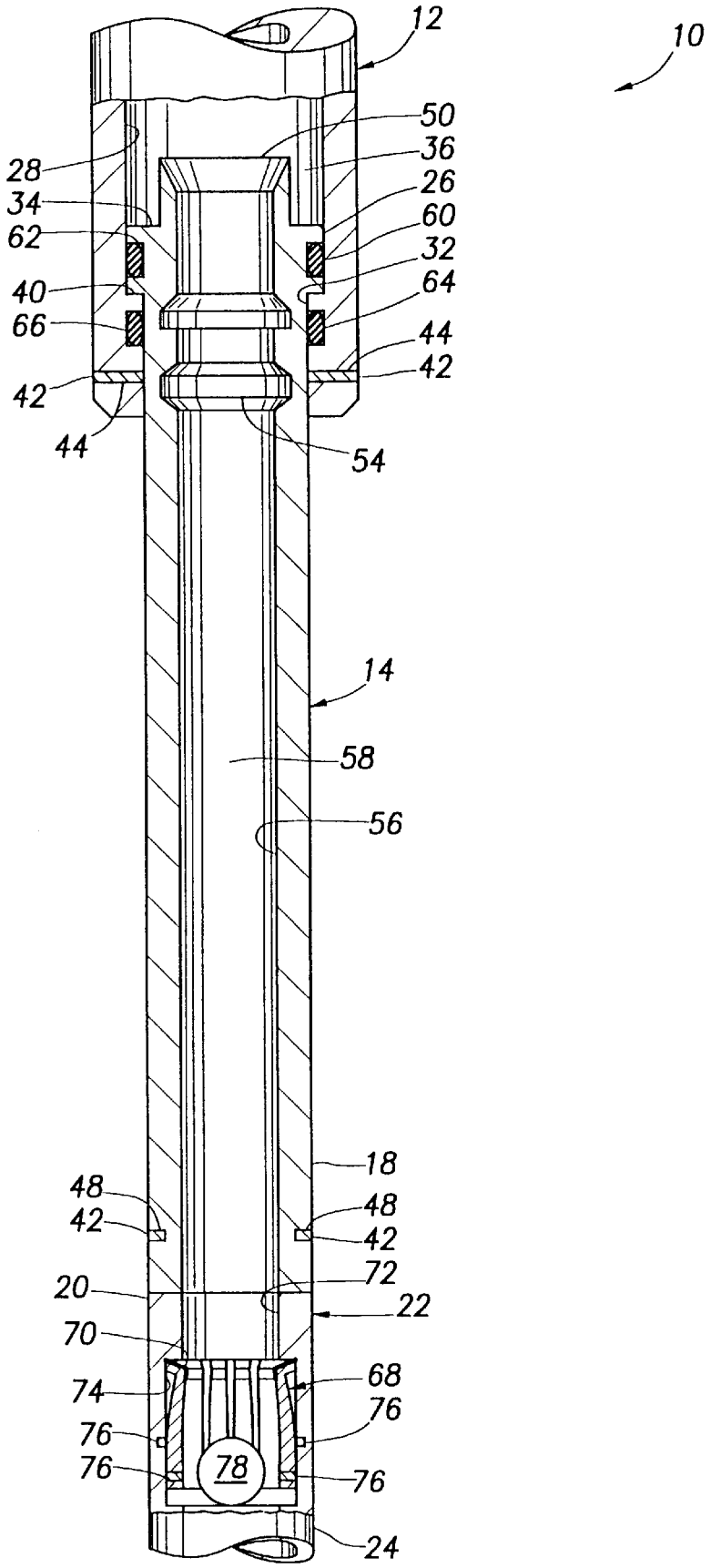
FIG. 1B is a schematicized partially cross-sectional view of the apparatus illustrated in FIG. 1A in an extended configuration thereof.

Turning now to FIG. 1B, the apparatus 10 of FIG. 1A is shown in its fully extended configuration. Shear pins 42 have been sheared, allowing the inner tubular member 14 to move axially downward as viewed in FIG. 1B until the radially enlarged portion 34 contacts the inner shoulder 40 of the outer tubular member 12. Movement of the inner tubular member 14 relative to the outer tubular member 12 after the shear pins 42 are sheared may be caused by the force resulting from the pressure applied to the interior flow passage 58 or, if the apparatus 10 is oriented at least partially vertically, by the weight of the inner tubular member 14, ball catcher 22, and the equipment attached thereto, or by any combination thereof.

As viewed in FIG. 1B, the shear pins 76 have also been sheared and the fingered inner sleeve 68 has been shifted axially downward relative to the outer housing 20 of the ball catcher 22, permitting the ball seat 70 to expand into the enlarged diameter 74. The ball 78 is thus permitted to pass through the ball seat 70.

As described hereinabove, the pressure applied to the inner flow passage 58 to shear the shear pins 76 in the ball catcher 22 is greater than the pressure required to shear the shear pins 42 which secure the inner tubular member 14 against axial movement relative to the outer tubular member 12. Thus, as pressure is built up in the inner flow passage 58, the shear pins 42 shear first, the inner tubular member 14 then moves axially downward as viewed in FIG. 1B, and then the pressure build-up continues in the inner flow passage until the shear pins 76 in the ball catcher 22 shear, releasing the ball 78.

Figure 2A:
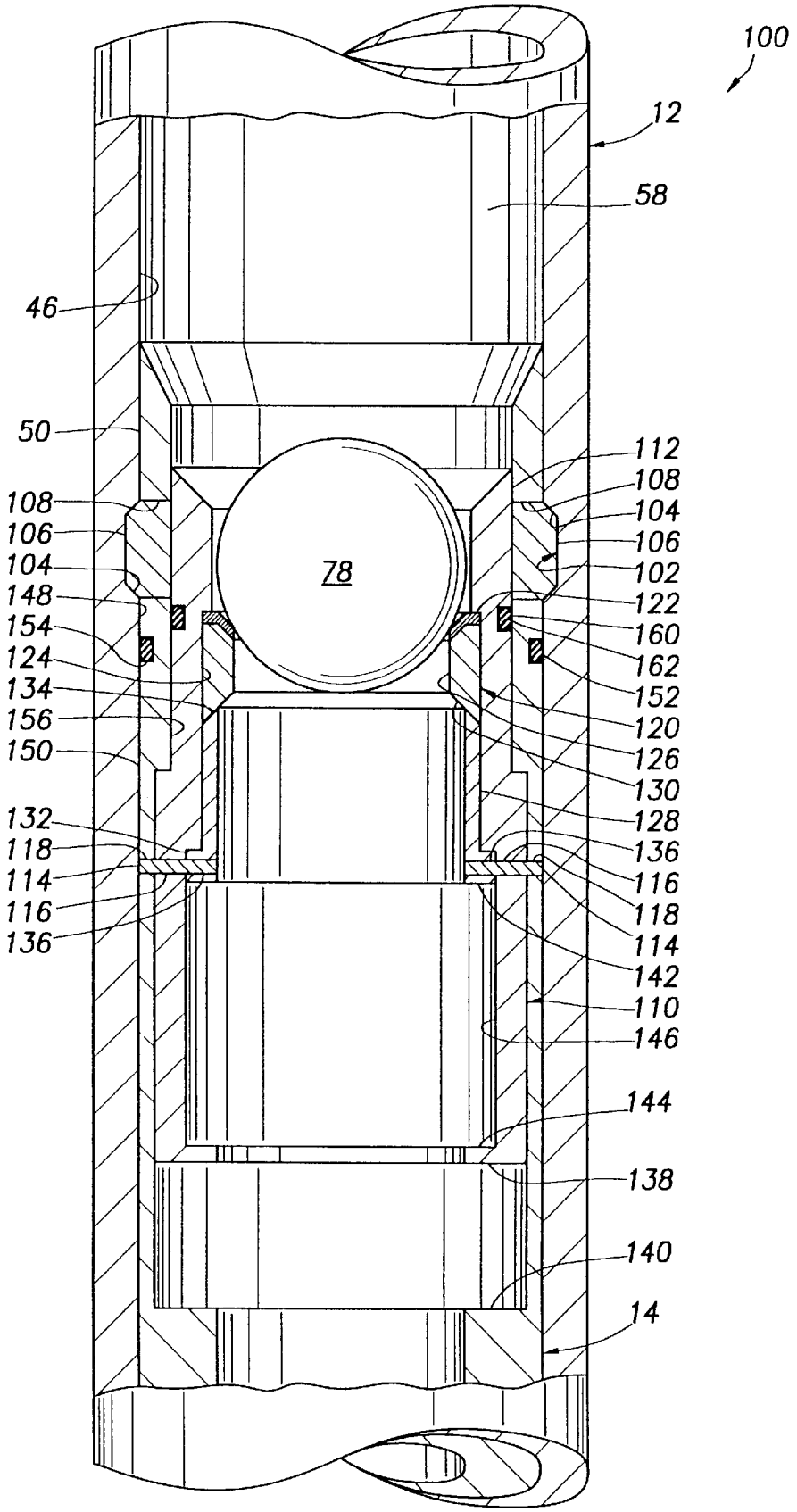
FIG. 2A is a schematicized partially cross-sectional view of a second wellbore equipment positioning apparatus embodying principles of the present invention in a secured configuration thereof.

Turning now to FIG. 2A, an alternative device 100 is shown for releasably securing the inner tubular member 14 against axial movement relative to the outer tubular member 12 in the apparatus 10. Device 100 eliminates the need for the ball catcher 22 disposed between the end portion 18 of the inner tubular member 14 and the equipment described hereinabove as being attached to the end portion 24 of the ball catcher 22. Additionally, device 100 eliminates the possibility that the shear pins 42 may be sheared or otherwise damaged while the apparatus 10 is run in the wellbore.

Device 100 includes a circumferential groove 102 formed on the internal diameter 46 of the outer tubular member 12.

Opposite radially extending shoulders 104 of the groove 102 are longitudinally sloped. A plurality of complimentarily shaped lugs or collets 106 extend radially outwardly into the groove 102. The lugs 106 also extend radially inwardly through complimentarily shaped apertures 108 formed through the end portion 50 of inner tubular member 14.

Maintaining the lugs 106 in cooperative engagement with the groove 102 is a sleeve 110, an outer diameter 112 of which is in contact with the lugs and which prevents the lugs from moving radially inwardly. Sleeve 110 is secured against axial movement relative to the inner tubular member 14 by radially extending shear pins 114 which extend through holes 116 in the sleeve 110 and holes 118 in the inner tubular member 14. Thus, as long as shear pins 114 remain intact, sleeve 110 is secured against axial movement relative to inner tubular member 14 and lugs 106 are maintained in cooperative engagement with groove 102, thereby securing the inner tubular member 14 against axial movement relative to the outer tubular member 12.

A conventional compressible ball seat 120, having on opposite ends an upper ball sealing surface 122 and a lower radially extending and longitudinally sloping surface 130, is radially compressed and coaxially disposed in an inner diameter 124 of the sleeve 110. While disposed in the inner diameter 124, the ball seat 120 remains radially compressed, such that inner diameter 126 of the ball seat 120 and the ball sealing surface 122 is less than the diameter of the ball 78, preventing the ball from passing axially therethrough and permitting the ball to sealingly engage the ball sealing surface.

The compressible ball seat 120 is maintained in the inner diameter 124 and secured against axial displacement relative to the sleeve 110 by coaxially disposed inner mandrel 128, having on opposite ends a radially enlarged outer diameter 132 and a radially extending and longitudinally sloping surface 134. The sloping surface 134 is configured to complimentarily engage the radially sloping surface 130 of the compressible ball seat 120. The inner mandrel 128 is secured against axial movement relative to the sleeve 110 by radially extending shear pins 114 which extend through holes 136 formed in inner mandrel 128.

Shear pins 114 thus extend radially through holes in the inner mandrel 128, sleeve 110, and inner tubular member 14, securing each against axial movement relative to the others. If shear pins 114 are sheared between the inner tubular member 14 and the sleeve 110, the sleeve is permitted to move axially downward as viewed in FIG. 2B relative to the inner tubular member until lower shoulder 138 of sleeve 110 contacts shoulder 140 of inner tubular member 14. The distance from shoulder 138 to shoulder 140 is sufficiently great that if sleeve 110 moves axially downward as viewed in FIG. 2B sufficiently far for shoulder 138 to contact shoulder 140, lugs 106 will no longer be maintained in radially outward cooperative engagement with groove 102 by the sleeve 110. Lugs 106 will then be permitted to move radially inward, releasing the inner tubular member 14 for axial displacement relative to outer tubular member 12.

Figure 2B:
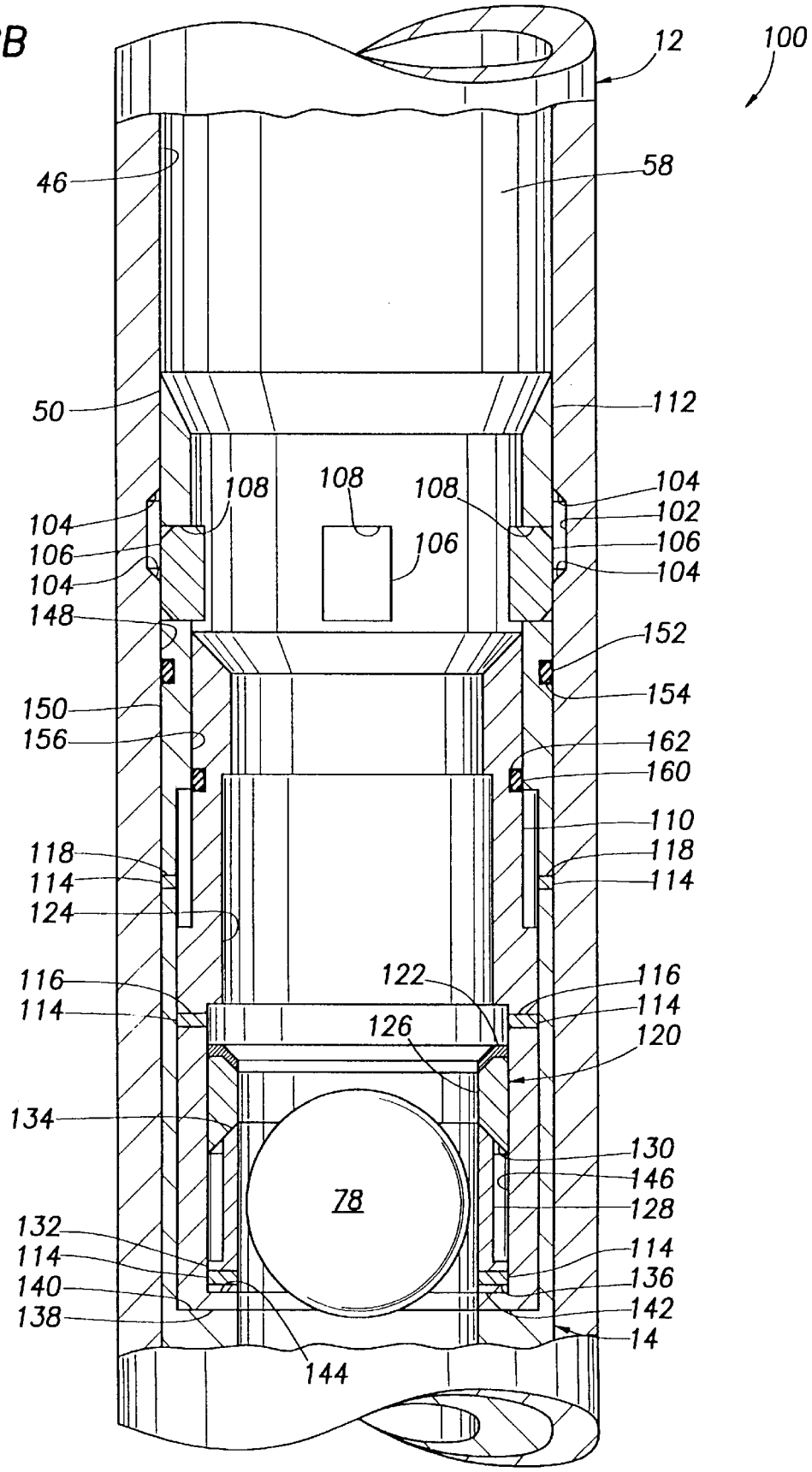
FIG. 2B is a schematicized partially cross-sectional view of the apparatus illustrated in FIG. 2A in a released configuration thereof.

If shear pins 114 are sheared between the inner mandrel 128 and the sleeve 110, the inner mandrel is permitted to move axially downward as viewed in FIG. 2B until shoulder 142 on the inner mandrel contacts shoulder 144 on the sleeve 110. If the inner mandrel 128 moves axially downward sufficiently far for shoulder 142 to contact shoulder 144, the inner mandrel 128 will no longer maintain the compressible ball seat 120 in the inner diameter 124 of the sleeve 110, and the compressible ball seat will be permitted to move axially downward and expand into radially enlarged inner diameter 146 of the sleeve. If the compressible ball seat 120 expands into the enlarged inner diameter 146, its inner diameter 126 will enlarge to a diameter greater than the diameter of the ball 78, permitting the ball to pass axially through the compressible ball seat 120. Note that sloping surface 134, in complimentary engagement with sloping surface 130 of the compressible ball seat 120 aids in the expansion of the compressible ball seat when it enters the enlarged inner diameter 146 of the sleeve 110.

Inner diameter 148 of outer tubular member 12 has a polished surface and is slightly larger than outside diameter 150 of inner tubular member 14. A seal 152 disposed in a circumferential groove 154 formed on outside diameter 150 provides a fluid and pressure seal between the inner and outer tubular members 14 and 12. Inner diameter 156 of inner tubular member 14 has a polished surface and is slightly larger than outside diameter 112 of sleeve 110. A seal 160 disposed in a circumferential groove 162 formed on outside diameter 112 provides a fluid and pressure seal between the inner tubular member 14 and the sleeve 110. Note that when the ball 78 is sealingly engaged on ball sealing surface 122, and pressure is applied to the inner flow passage 58 above the ball 78 as viewed in FIG. 2A, a larger piston area is formed by seal 160 than is formed by the ball sealing surface 122. Thus, as will be readily appreciated by one skilled in the art, the resulting downwardly biasing force borne by the shear pins 114 between the inner tubular member 14 and the sleeve 110 is greater than the resulting force borne by the shear pins 114 between the inner mandrel 128 and the sleeve 110. Or, put another way, a greater pressure must be applied to the inner flow passage 58 above the ball 78 to shear the shear pins 114 between the sleeve 110 and the inner mandrel 128 than must be applied to shear the shear pins 114 between the sleeve 110 and the inner tubular member 14. Of course, additional shear pins 114, and/or larger shear pins, may be utilized to increase the pressure required to shear the shear pins. In addition, it is not necessary for the same shear pins 114 to secure the inner mandrel 128, sleeve 110, and inner tubular member 14 against relative axial movement, since separate shear pins may also be utilized.

Turning now to FIG. 2B, the device 100 is shown after the shear pins 114 have been sheared, both between the sleeve 110 and the inner tubular member 14 and between the inner mandrel 128 and the sleeve 110. For illustrative clarity, the inner tubular member 14 is shown as being only slightly moved axially downward relative to the outer tubular member 12, but it is to be understood that, as with the apparatus 10 representatively illustrated in FIG. 1B, the inner tubular member 14, once released, may be permitted to move a comparatively much larger distance axially relative to the outer tubular member 12.

When ball 78 is installed in inner flow passage 58, sealingly engaging ball sealing surface 122, and sufficient pressure is applied to the inner flow passage above the ball, shear pins 114 shear initially between the inner tubular member 14 and the sleeve 110. The force resulting from the pressure differential across the ball 78 moves the sleeve 110 downward, uncovering the lugs 106, and permitting the lugs to move radially inward. The inner tubular member 14 is thus permitted to move axially downward relative to the outer tubular member 12. The pressure differential across the ball 78 may then be used, if necessary, to force the inner tubular member 14 to extend telescopically from within the outer tubular member 12.

When the inner tubular member 14 is completely extended, application of additional pressure to the inner flow passage 58 above the ball 78 may be used to produce a sufficient differential pressure across the ball to shear the shear pins 114 between the sleeve 110 and the inner mandrel 128. The differential pressure will then force the inner mandrel 128 and compressible ball seat 120 axially downward until the compressible ball seat enters the radially enlarged inner diameter 146 of the sleeve 110 and expands. Sloping surface 134 on the inner mandrel 128, in contact with the sloping surface 130 on the compressible ball seat 120, aids in expanding the compressible ball seat 120. When the compressible ball seat 120 has expanded into the radially enlarged inner diameter 146, the inside diameter 126 of the ball sealing surface 122 and compressible ball seat 120 is larger than the diameter of the ball 78, and the ball is permitted to pass axially through the compressible ball seat 120.

For purposes which will become apparent upon consideration of the written description accompanying FIGS. 13A–13C and 14A–14B, outer tubular member 12 may alternatively be perforated such that fluid communication is established between flow passage 58 and the wellbore after inner tubular member 14 is axially extended. Such perforation of outer tubular member 12 should preferably be below the seal 152.

Figure 3A:
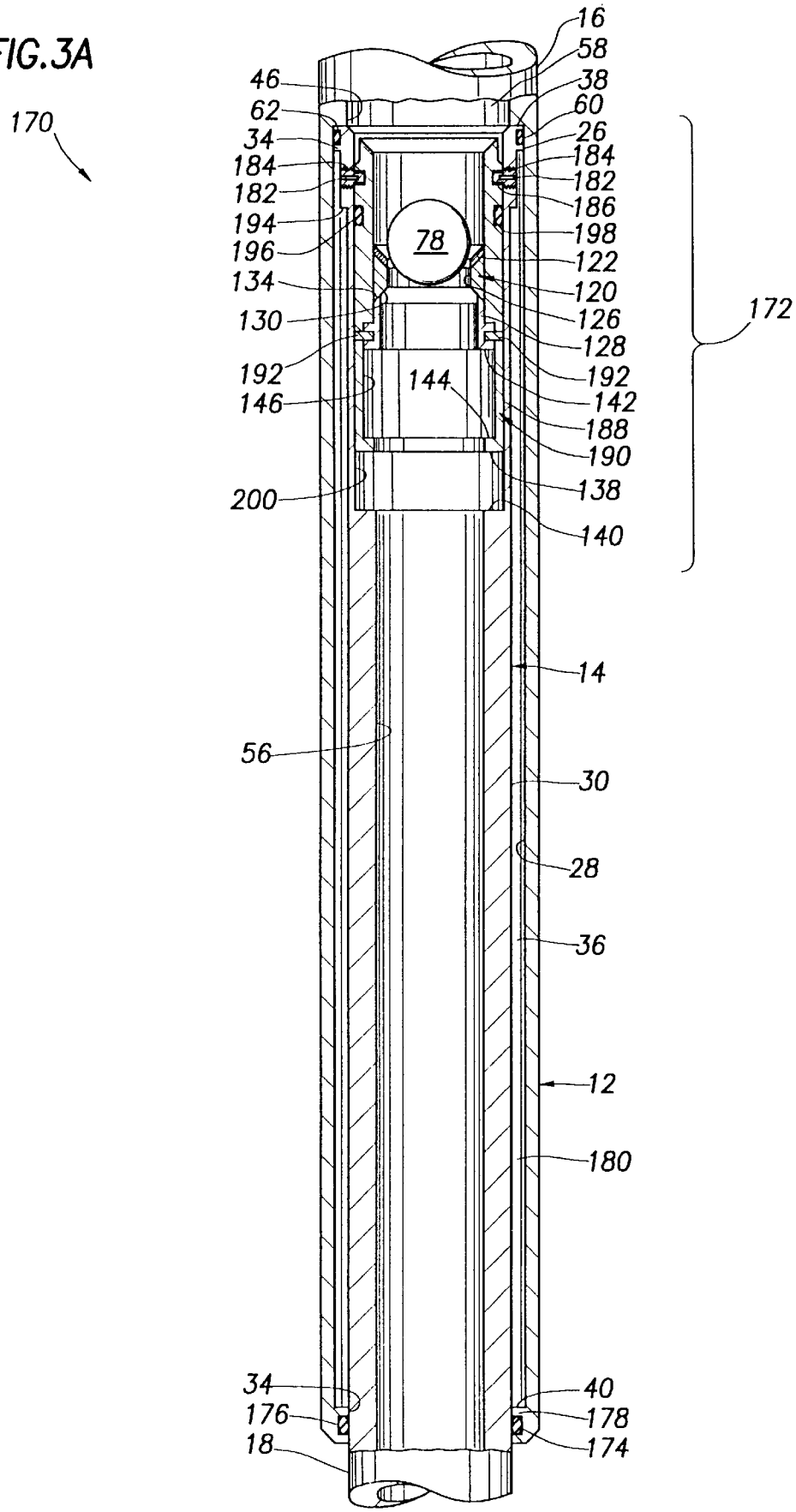
FIG. 3A is a schematicized partially cross-sectional view of a third wellbore equipment positioning apparatus embodying principles of the present invention in a compressed position thereof.

Turning now to FIG. 3A, another apparatus 170 for positioning equipment within a wellbore embodying the principles of the present invention may be seen in a compressed configuration thereof. Apparatus 170 includes a release mechanism 172. For convenience and clarity of the following description of the apparatus 170 and release mechanism 172, some elements shown in FIG. 3A have the same numbers as those elements having substantially similar functions which were previously described in relation to FIGS. 1A–2B.

Apparatus 170 includes outer and inner coaxial telescoping tubular members 12 and 14, respectively. Upper end 16 of outer tubular member 12 is secured against axial movement relative to the wellbore by, for example, attachment to a packer set in the wellbore, suspension from slips or an elevator on a rig, etc. Equipment, such as screens, perforating guns, etc., is attached to the lower end 18 of the inner tubular member 14.

An annular area 36 between a polished inside diameter 28 of the outer tubular member 12 and a polished outer diameter 30 of the inner tubular member 14 is substantially filled with a substantially incompressible liquid 180, for example, oil or silicone fluid. The annular area 36 is sealed at opposite ends by seal 60 in groove 62 on radially enlarged portion 34 of the inner tubular member 14 and by seal 174 in groove 176 on radially reduced diameter portion 178 of the outer tubular member 12. In the configuration illustrated in FIG. 3A, inner tubular member 14 is prevented from moving axially upward relative to outer tubular member 12 by contact between the enlarged portion 34 of the inner tubular member 14 and an internal shoulder 38 formed in the outer tubular member 12. Inner tubular member 14 is prevented from moving appreciably axially downward relative to outer tubular member 12 by the substantially incompressible liquid 180 in the annular area 36.

To permit movement of the inner tubular member 14 downward relative to the outer tubular member 12, in order to alter the position of the equipment in the wellbore, the liquid 180 is permitted to escape from the annular area 36 through apertures 182 in conventional break plugs 184. The break plugs 184 are threadedly and sealingly installed in the inner tubular member 14 so that they extend radially inward from the annular area 36 and through the inner tubular member 14. The apertures 182 extend radially inward from an end of each break plug 184 exposed to the annular area 36, and into, but not through, an end of the break plug 184 which extends radially inward into a circumferential groove 186 formed on an outer diameter 188 of a sleeve 190.

As will be readily appreciated by a person of ordinary skill in the art, if sleeve 190 moves axially downward relative to the inner tubular member 14, thereby shearing the portions of the break plugs 184 which extend into groove 186, apertures 182 will form flow paths for fluid communication between the annular area 36 and inner flow passage 58. If the pressure existing in the inner flow passage 58 is greater than the pressure existing external to the apparatus 170, or if the weight of the equipment pulling downward on the inner tubular member 14 is sufficiently great, the liquid 180 will be forced through the apertures 182 and into the inner flow passage 58 as the annular area 36 decreases in volume. In this manner, the inner tubular member 14 is permitted to move axially downward relative to the outer tubular member 12.

In the release mechanism 172, the sleeve 190 is made to move downward relative to the inner tubular member 14 to shear the break plugs 184 by substantially the same method as that used to move the sleeve 110 downward relative to the inner tubular member 14 to release the lugs 106 in the release mechanism 100 illustrated in FIGS. 2A and 2B described hereinabove. A ball 78 is installed in sealing engagement with a ball sealing surface 122 on a compressible ball seat 120. A seal 196 disposed in a circumferential groove 198 formed on outside diameter 188 of the sleeve 190 sealingly engages a polished enlarged inside diameter 200 of the inner tubular member 14. Pressure is applied to the inner flow passage above the ball 78 so that a pressure differential is created across the ball. The force resulting from the differential pressure across the ball 78 pushes axially downward on the ball seat 120, which in turn pushes axially downward against an inner mandrel 128. The inner mandrel 128 is restrained against axial movement relative to the sleeve 190 by radially extending shear pins 192. When the resulting force is sufficiently large, the break plugs 184 shear, permitting the sleeve 190 to move axially downward relative to the inner tubular member 14, permitting the liquid 180 in the annular area 36 to flow through apertures 182 and into the inner flow passage 58, thereby permitting the inner tubular member 14 to move axially downward relative to the outer tubular member 12.

When the inner tubular member 14 has been extended fully from within the outer tubular member 12, shoulder 194 on the inner tubular member 14 contacts shoulder 40 on radially reduced diameter portion 178 of the outer tubular member 12, preventing further axially downward movement of the inner tubular member relative to the outer tubular member. Application of additional pressure to the inner flow passage 58 above the ball 78 is then utilized to shear pins 192 securing inner mandrel 128 against axial movement relative to the sleeve 190. The force resulting from this application of additional pressure then moves the ball 78, compressible ball seat 120, and inner mandrel 128 axially downward relative to the sleeve 190 until shoulder 142 on the inner mandrel contacts shoulder 144 on the sleeve 190, permitting the compressible ball seat 120 to enter a radially enlarged diameter 146 on the sleeve. When the compressible ball seat 120 enters the diameter 146 it expands radially, aided by a radially extending and longitudinally sloped surface 134 on the inner mandrel 128 in contact with a complimentarily sloped surface 130 on the compressible ball seat 120, such that its inside diameter 126 becomes larger than the diameter of the ball 78. The ball 78 may then pass freely axially through the compressible ball seat 120. Note that for the proper sequential shearing of the break plugs 184 and shear pins 192, the pressures applied to the inner flow passage 58 above the ball 78 to create a pressure differential across the ball must be preselected so that less pressure is required to shear the break plugs 184 than to shear the shear pins 192.

Figure 3B:
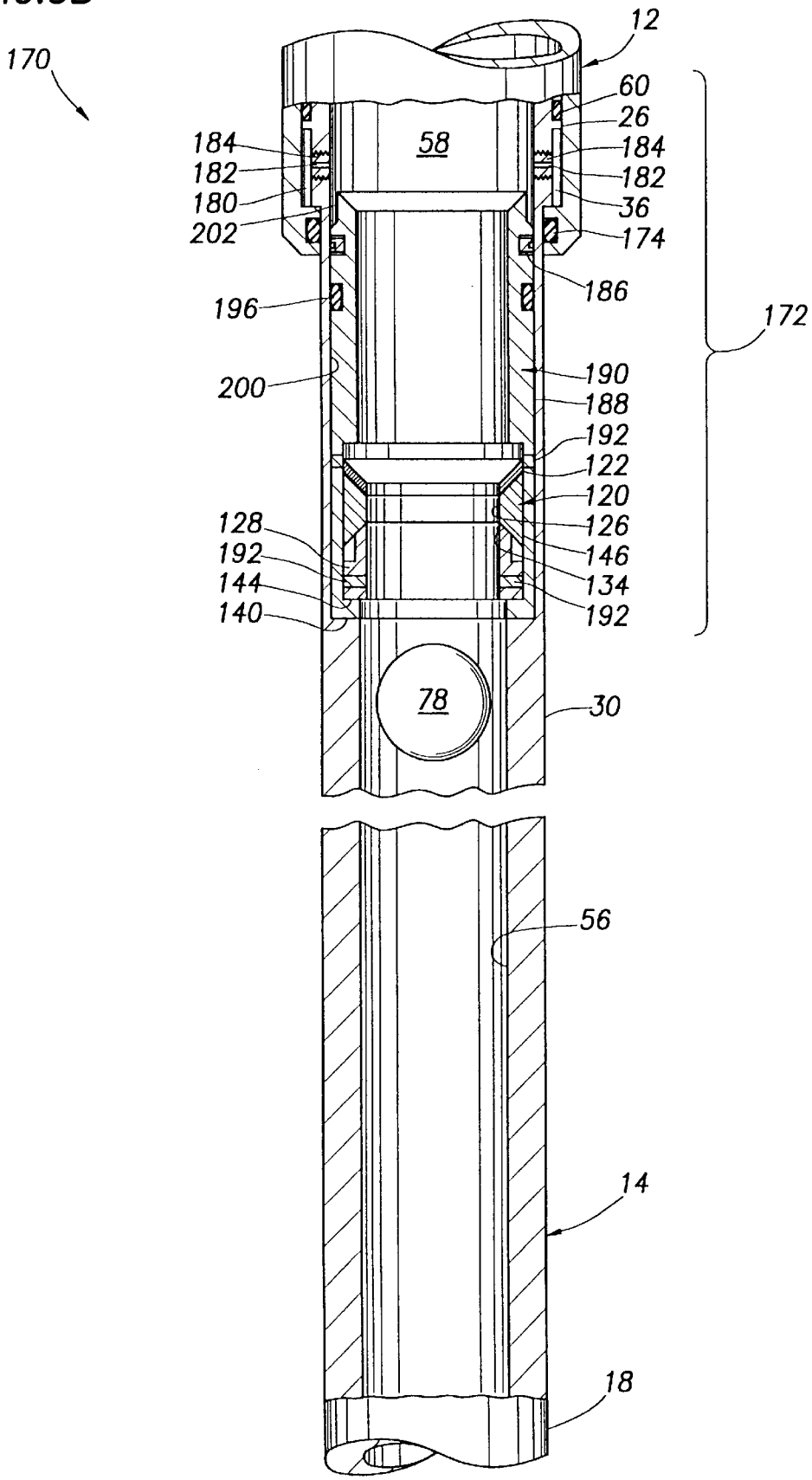
FIG. 3B is a schematicized partially cross-sectional view of the apparatus illustrated in FIG. 3A in an extended configuration thereof.

Illustrated in FIG. 3B is the apparatus 170 shown in FIG. 3A in an extended configuration thereof. The break plugs 184 have been sheared and substantially all of the fluid 180 has escaped from the annular area 36 into the inner flow passage 58. A radially reduced outer diameter 202 on the sleeve 190 provides a flow path about the sleeve.

The shear pins 192 have also been sheared, permitting the inner mandrel 128 and compressible ball seat 120 to move axially downward relative to the sleeve 190 and permitting the compressible ball seat 120 to expand radially into the enlarged inside diameter 146. Ball 78 may now pass axially through the radially expanded inside diameter 126 of compressible ball seat 120. The inner tubular member 14 has thus been axially extended from within the outer mandrel 12 to alter the position in the wellbore of the equipment attached to the lower end 18 of the inner tubular member 14.

Figure 4A:
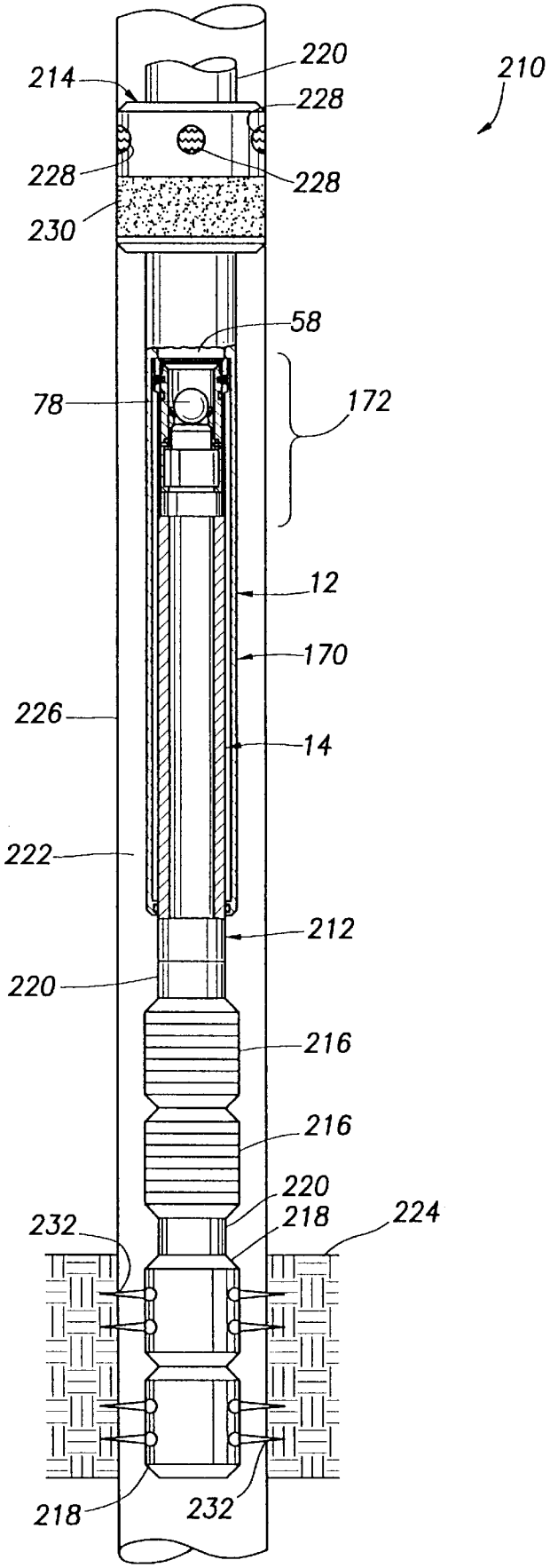
FIG. 4A is a schematicized partially cross-sectional view of a method of completing a subterranean well embodying principles of the present invention utilizing the apparatus illustrated in FIG. 3A, here shown in a compressed configuration thereof, with a zone to be produced being perforated.

Illustrated in FIG. 4A is a preferred method 210 of using the apparatus 170 shown in FIGS. 3A and 3B to complete a well. The apparatus 170, utilizing release mechanism 172 and configured in its axially compressed configuration as shown in FIG. 3A, is attached in a tool string 212 between a conventional packer 214 and a pair of conventional sand screens 216.

The tool string 212 includes, in order from the bottom upward, a pair of conventional perforating guns 218, a section of tubing 220, the sand screens 216, another section of tubing 220, the apparatus 170, the packer 214, and further tubing 220 extending to the surface. It is to be understood that the tool string 212 may include other and different items of equipment for use in a wellbore 222 which are not shown in FIG. 4A without deviating from the principles of the present invention. It is also to be understood that, although the tool string 212, including the apparatus 170, is illustrated in FIG. 4A as being oriented vertically, and the following description of the preferred method 210 refers to this vertical orientation through the use of terms such as "upward", "downward", "above", "below", etc., the tool string 212 may also be oriented horizontally, inclined, or inverted, and these directional terms are used as a matter of convenience to refer to the orientation of the tool string as illustrated in FIG. 4A.

The tool string 212 is lowered longitudinally into the wellbore 222 from the surface until the perforating guns 218 are positioned longitudinally opposite a potentially productive formation 224. The packer 214 is then set in casing 226 lining the wellbore 222. As the packer 214 is set, slips 228 bite into the casing 226 to prevent axial movement of the tool string 212 relative to the wellbore 222, and rubbers 230 expand radially outward to sealingly engage the casing 226.

The perforating guns 218 are fired radially outward, forming perforations 232 extending radially outward through the casing 226 and into the formation 224. The perforations 232 are formed so that hydrocarbons or other useful fluids in the formation 224 may enter the wellbore 222 for transport to the surface. Note that many conventional methods have been developed for firing the perforating guns 218, none of which are described herein as they are not within the scope of the present invention.

The apparatus 170 is then extended axially as set forth in the detailed description above in relation to FIGS. 3A and 3B. The ball 78 is installed into the release mechanism 172 and pressure is applied to the inner flow passage 58 above the ball to shear the break plugs 184, thus permitting the inner tubular member 14 to move axially downward relative to the outer tubular member 12. Additional pressure is then applied to the inner flow passage 58 above the ball 78 to shear the shear pins 192, thus permitting the ball 78 to pass axially through the compressible ball seat 120 (see FIGS. 3A and 3B).

Figure 4B:
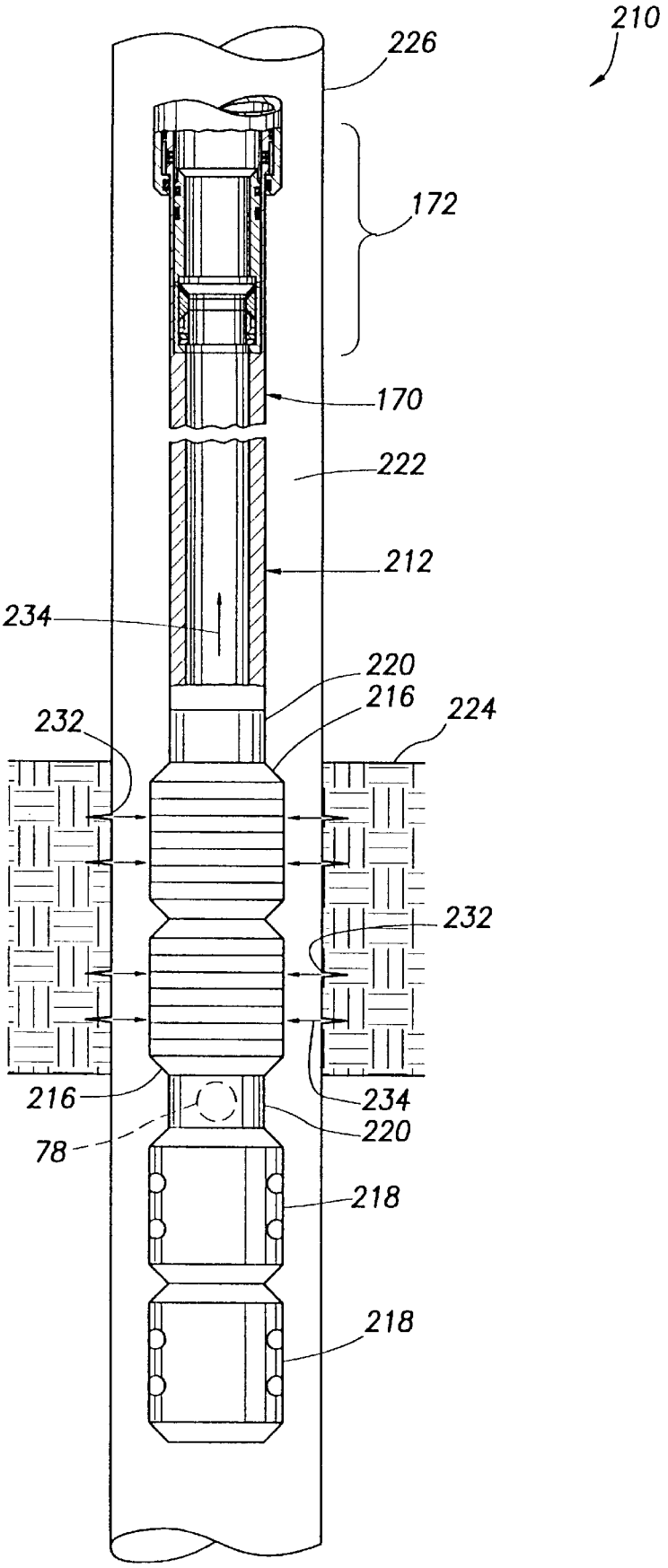
FIG. 4B is a schematicized partially cross-sectional view of a method of completing a subterranean well embodying principles of the present invention utilizing the apparatus illustrated in FIG. 3A, here shown in an extended configuration thereof, with a pair of screens positioned opposite the perforated and producing zone.

FIG. 4B illustrates the method 210 of using the apparatus 170 after the inner tubular member 14 has been axially extended from within the outer tubular member 12. The screens 216 are now positioned longitudinally opposite the formation 224 so that flow 234 from the formation may pass directly through the perforations 232, into the wellbore 222, and thence directly into the screens 216. The screens 216 filter particulate matter from the flow 234 before it enters the tool string 212, so that the particulate matter does not clog or damage any equipment.

Note that the ball 78 has come to rest in the section of tubing 220 between the screens 216 and the perforating guns 218. In this position the ball 78 is not in the way of the flow 234 as it enters the screens 216 and travels toward the surface in the inner flow passage 58.

Figure 5A:
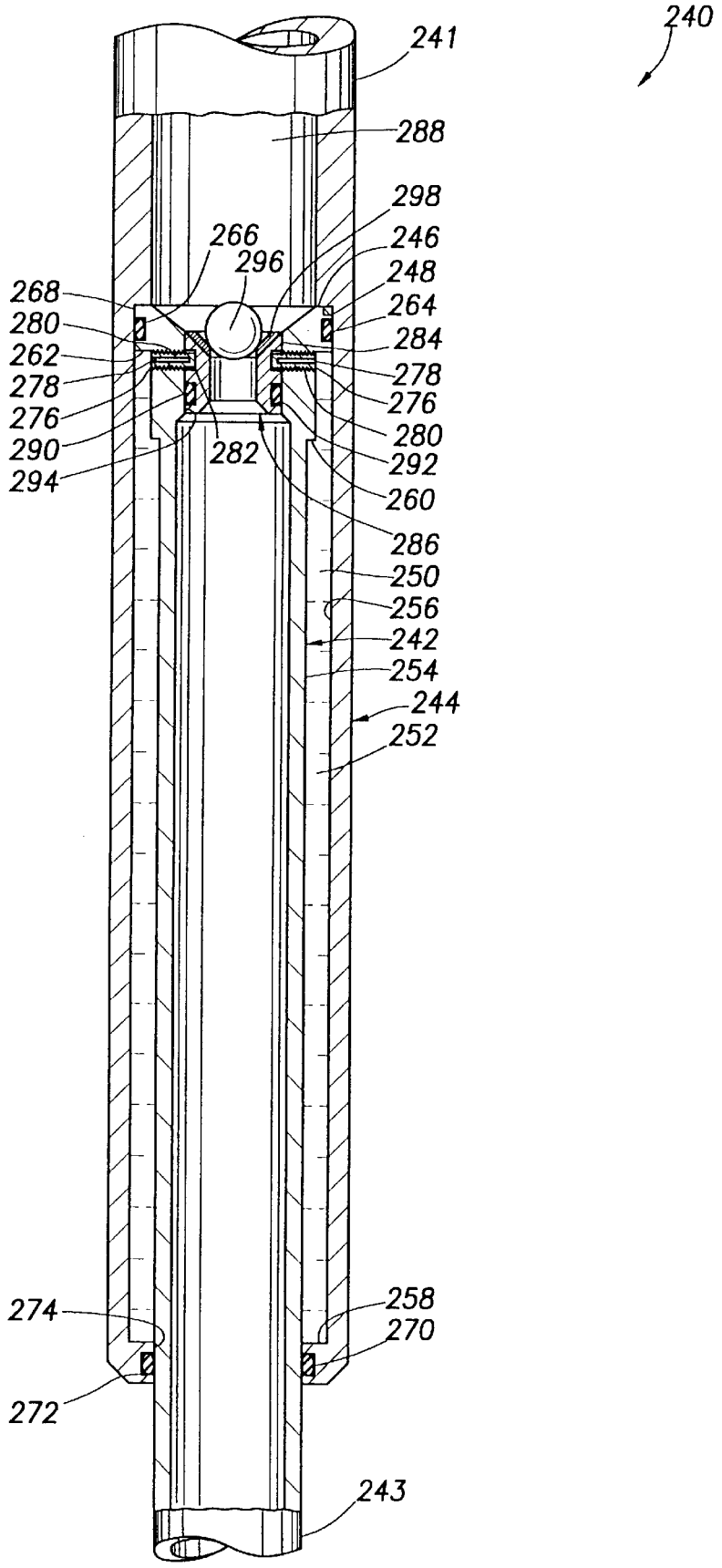
FIG. 5A is a schematicized partially cross-sectional view of a fourth wellbore equipment positioning apparatus embodying principles of the present invention in a compressed configuration thereof.

FIG. 5A shows an apparatus 240 for positioning equipment in a wellbore which is another embodiment of the present invention. The apparatus 240 is illustrated in a compressed configuration thereof. Upper end portion 241 is preferably attached to a packer (not shown) or other device for preventing its axial movement within the wellbore. Lower end portion 243 is preferably attached to an item, or multiple items, of equipment, for example, tubing, sand screen, or perforating gun. Telescoping coaxial inner and outer tubular members, 242 and 244 respectively, are shown substantially overlapping each other with shoulder 246 on the inner tubular member 242 contacting shoulder 248 on the outer tubular member 244, thereby preventing further compression of the apparatus 240.

Inner tubular member 242 is prevented from moving appreciably axially downward relative to outer tubular member 244 by a substantially incompressible fluid 250 contained in an annular space 252 between the inner and outer tubular members 242 and 244. Annular space 252 is radially bounded by a polished outer diameter 254 of the inner tubular member 242, and by a polished inner diameter 256 of the outer tubular member 244. Annular space 252 is longitudinally bounded by a shoulder 258 on the outer tubular member 244, and by shoulders 260 and 262 on the inner tubular member 242. Annular space 252 is sealed at its opposite ends by seal 264 disposed in a circumferential groove 266 formed on a radially enlarged portion 268 of the inner tubular member 242, and by seal 270 disposed in a circumferential groove 272 formed on a radially reduced portion 274 of the outer tubular member 244. Seal 264 sealingly engages inner diameter 256 of outer tubular member 244 and seal 270 sealingly engages outer diameter 254 of inner tubular member 242.

A pair of conventional radially extending break plugs 276 having axial apertures 278 extending partially therethrough are threadedly and sealingly installed in threaded holes 280 extending radially through the inner tubular member 242 between the shoulders 260 and 262. The break plugs 276 extend radially from the annular space 252, through the inner tubular member 242, and into a circumferential groove 282 formed on an outer diameter 284 of a ball seat 286. The aperture 278 in each break plug 276 extends from the annular space 252 past the outer diameter 284 of ball seat 286, so that if ball seat 286 moves axially relative to the inner tubular member 242, thereby shearing the break plugs 276 at the outer diameter 284, apertures 278 will form a flow path between the annular space 252 and an inner flow passage 288 extending axially through the inner and outer tubular members 242 and 244.

Coaxially disposed ball seat 286 is prevented from moving axially relative to the inner tubular member 242 by the break plugs 276 which extend radially into groove 282 as described above. Ball seat 286 includes a ball sealing surface 298 disposed on a radially extending and longitudinally sloping upper surface of the ball seat. A seal 290 disposed in a circumferential groove 292 on outer diameter 284 of ball seat 286 sealingly contacts a polished, radially reduced, inner diameter 294 of the inner tubular member 242. When a ball 296 is installed in the inner flow passage 288 above the ball seat 286, a pressure differential may be created across the ball by bringing it into sealing contact with the ball sealing surface 298 (the ball's weight may accomplish this, or flow may be induced in the inner flow passage to move the ball into contact with the ball sealing surface), and applying pressure to the inner flow passage 288 above the ball 296. A downwardly directed axial force will result from the differential pressure across the ball 296. The resulting downwardly directed force will push axially downward on the ball seat 286, and be resisted by the break plugs 276, until the break plugs shear between the inner diameter 294 of the inner tubular member 242 and the outer diameter 284 of the ball seat.

When the break plugs 276 shear, the ball 296 and ball seat 286 are permitted to move axially downward through the inner tubular member 242, and apertures 278 each form a flow path from the annular space 252, through the break plug 276, and into the inner flow passage 288, thereby permitting downward axial movement of the inner tubular member 242 relative to the outer tubular member 244. The weight of the inner tubular member 242 and the equipment attached to the lower end portion 243 will then pull the inner tubular member axially downward, forcing the liquid 250 through the apertures 278 as the volume of the annular space 252 decreases.

Figure 5B:
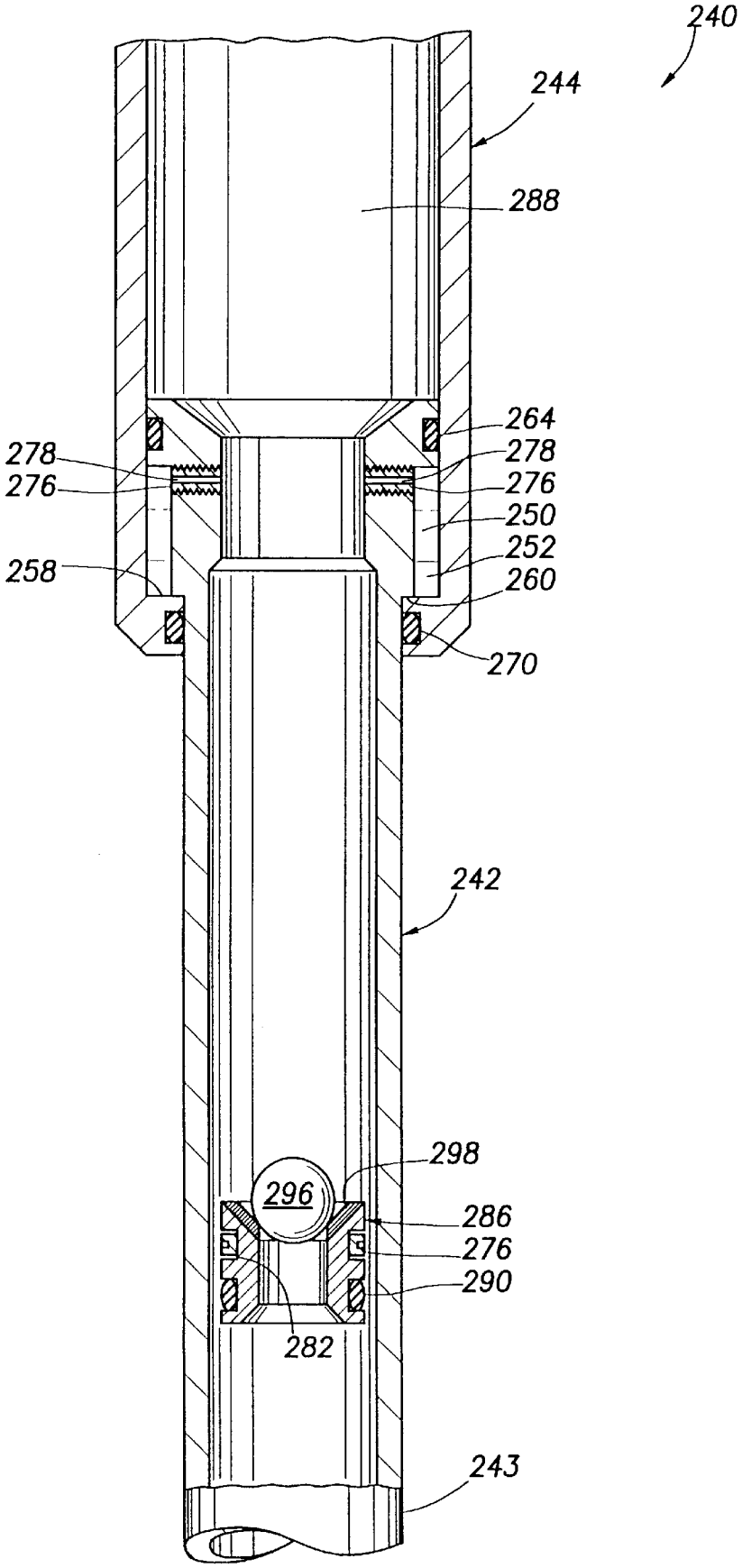
FIG. 5B is a schematicized partially cross-sectional view of the apparatus illustrated in FIG. 5A in an extended configuration thereof.

Illustrated in FIG. 5B is the apparatus 240 of FIG. 5A in an extended configuration thereof. Break plugs 276 have been sheared and the ball 296 and ball seat 286 are permitted to move axially downward through the inner tubular member 242. Substantially all of the liquid 250 has been forced out of the annular space 252, through the apertures 278, and into the inner flow passage 288. The inner tubular member 242 has been forced axially downward relative to the outer tubular member 244 until shoulder 260 contacts shoulder 258, thereby altering the position in the wellbore of the equipment attached to the lower end portion 243 of the inner tubular member.

Figure 6:
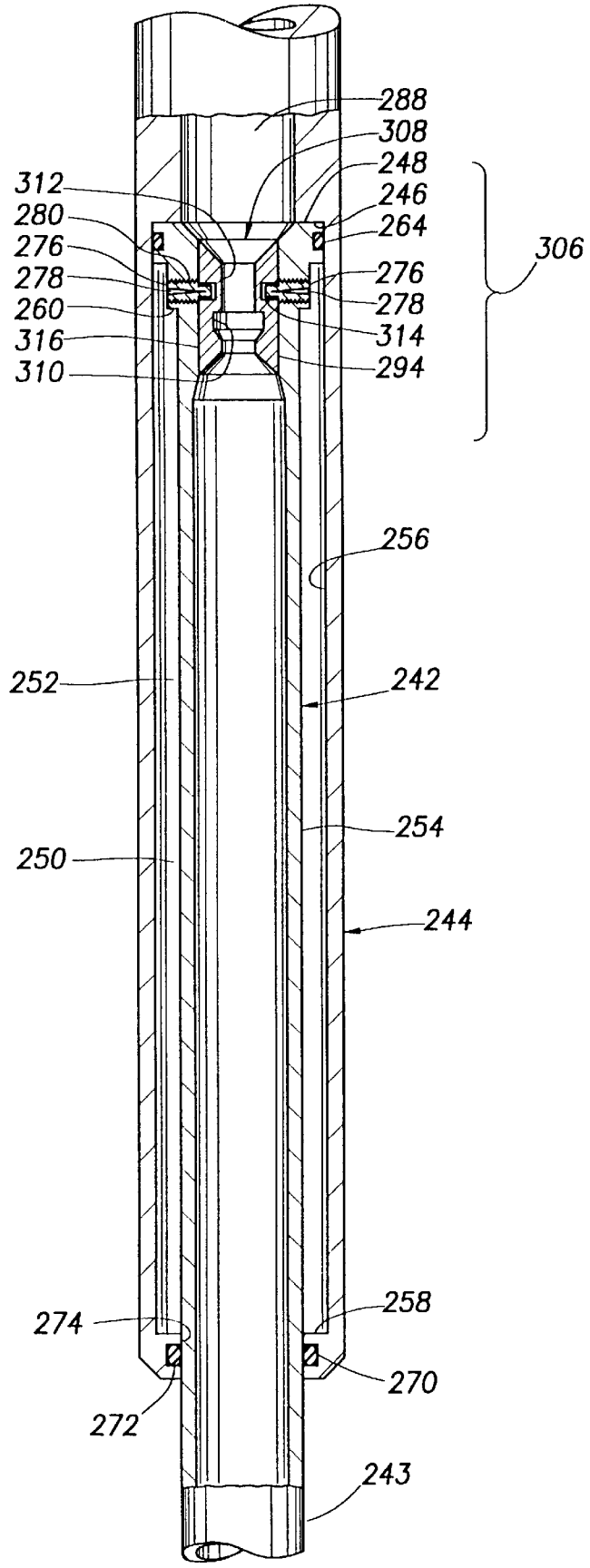
FIG. 6 is a schematicized partially cross-sectional view of a fifth wellbore equipment positioning apparatus embodying principles of the present invention.

Turning now to FIG. 6, another release mechanism 306 is shown, which may be utilized in the apparatus 240 of FIG. 5A described hereinabove. For convenience and clarity of the following description of the apparatus 240 and release mechanism 306, some elements shown in FIG. 6 have the same numbers as those elements having substantially similar functions which were previously described in relation to FIGS. 5A and 5B.

In release mechanism 306, a sliding sleeve 308 takes the place of the ball seat 286 shown in FIG. 5A. The sliding sleeve 308 includes a conventional latching profile 310 formed on an inner diameter 312 thereof. Sliding sleeve 308 also includes a circumferential groove 314 formed on an outer diameter 316 thereof.

Break plugs 276 extend radially into the groove 314 and apertures 278 extend radially across the gap between inner diameter 294 of inner tubular member 242 and outer diameter 316 of the sliding sleeve 308. The latch profile 310 permits a conventional latching tool (not shown) to be latched onto the sliding sleeve 308 so that a force may be applied to the sliding sleeve to shear the break plugs 276. The sliding sleeve 308 may be moved axially downward through the inner tubular member 242 after the break plugs 276 have been sheared, or may be moved axially upward through the inner flow passage 288 by the latching tool and extracted at the surface.

As with the embodiment of the apparatus 240 shown in FIG. 5A, when the break plugs 276 are sheared, fluid 250 in annular space 252 is permitted to flow through the apertures 278 and into the inner flow passage 288. The inner tubular member 242 is then permitted to move axially downward relative to the outer tubular member 244.

Note that in the embodiment of the release mechanism 306 illustrated in FIG. 6, there is no seal on the outer diameter 316 of the sliding sleeve 308 comparable to the seal 290 on the outer diameter 284 of the ball seat 286 illustrated in FIG. 5A. This is because the release mechanism 306 requires no pressure differential for its movement. For the same reason, the reduced inner diameter 294 of the inner tubular member 242 does not need to be polished in this embodiment.

Figure 7A:
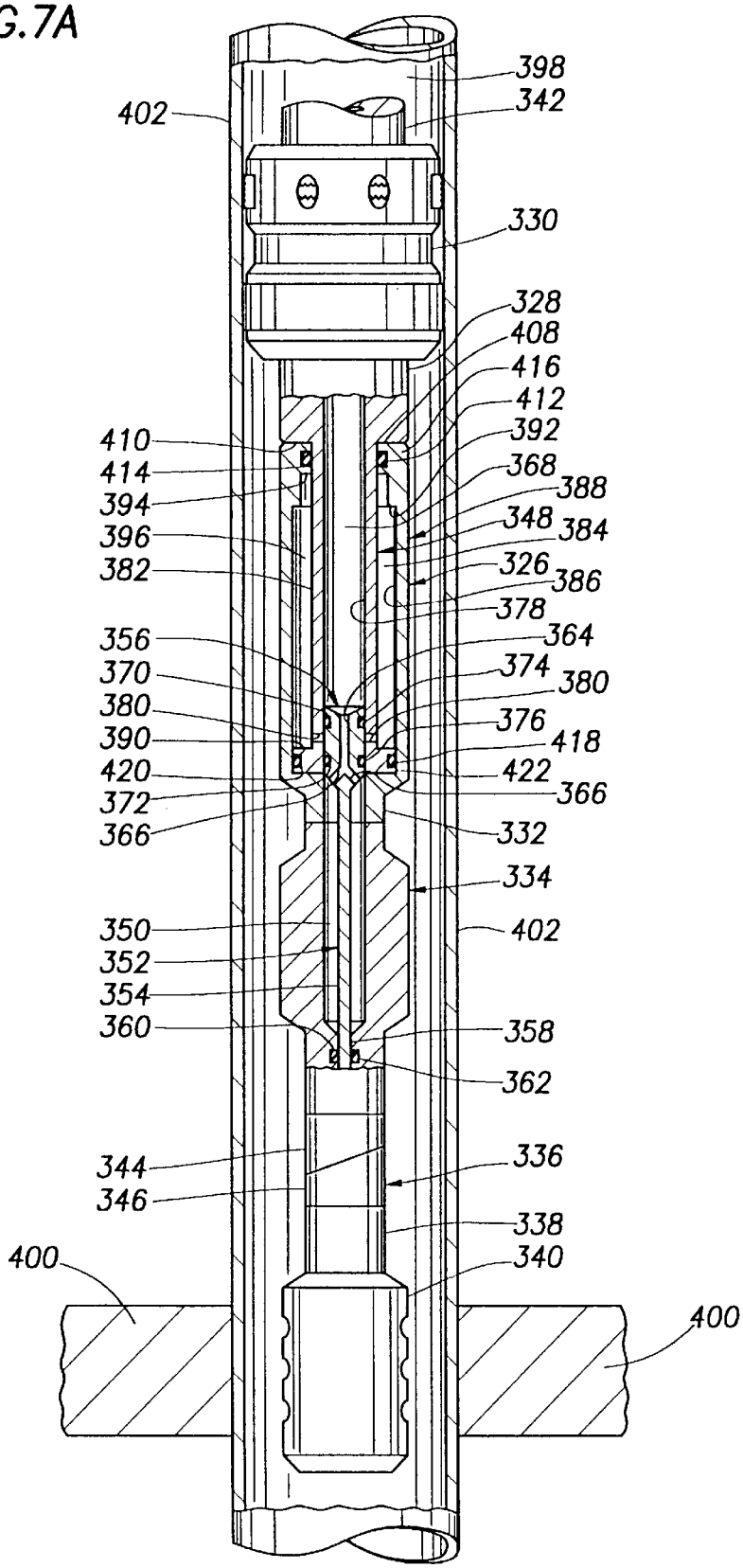
FIG. 7A is a schematicized partially cross-sectional view of a sixth wellbore equipment positioning apparatus embodying principles of the present invention in a compressed configuration thereof, and a second method of completing a subterranean well embodying principles of the present invention utilizing the apparatus, wherein a perforating gun is positioned opposite a zone to be perforated and produced.

Turning now to FIG. 7A, an apparatus 326 for positioning equipment in a subterranean wellbore 398 is illustrated installed in a tool string 342. The apparatus 326 is shown attached at its upper end 328 to a packer 330, and at its lower end 332 to items of equipment including a sand screen 334, gun release 336, gun firing head 338, and perforating gun 340. The perforating gun 340, firing head 338, and gun release 336 are conventional, other than a modification to a portion of the gun release 336 described hereinbelow. The illustrated gun release 336 is of the type that automatically releases all equipment attached below an inclined muleshoe portion 344 of the gun release when the perforating gun 340 is fired by the firing head 338.

Axially extending from the interior of an inner tubular member 348, through bore 350 of the screen 334, to an attachment point within a lower portion 346 of the gun release 336 is an actuating rod member 352. Lower portion 346 of the conventional gun release 336 is modified to accept attachment of the actuating rod 352 thereto. The actuating rod 352 is attached to the lower portion 346 of the gun release 336 so that when the gun release releases, the actuating rod 352 is pulled downward with the rest of the equipment.

Actuating rod 352 includes a polished cylindrical lower portion 354, which is the portion of the actuating rod which is attached to the lower portion 346 of the gun release 336 as described above, and a radially enlarged head portion 356, which extends coaxially into a lower interior portion of the inner tubular member 348. Between the bore 350 of the screen 334 and the muleshoe portion 344 of the gun release 336, the rod lower portion 354 extends axially through a radially reduced inner diameter 358 of the screen 334. The inner diameter 358 is slightly larger than the diameter of the rod lower portion 354 and includes a circumferential groove 360. A seal 362 disposed in the groove 360 sealingly engages the rod lower portion 354.

An axial flow port 364 extends from an upper surface of the rod head portion 356 axially downward into the head portion and intersects a pair of axially inclined and radially extending flow ports 366 which extend from a lower surface of the head portion. The axial and radial flow ports 364 and 366 provide fluid and pressure communication between the bore of the screen 350 and an axial inner flow passage 368 in the inner tubular member 348 above the head portion 356.

Head portion 356 is radially enlarged as compared to the rod lower portion 354 and includes a pair of longitudinally spaced apart circumferential grooves 370 and 372. Seals 374 and 376 are disposed in the grooves, 370 and 372 respectively, and sealingly engage a polished inner diameter 378 of the inner tubular member 348. Seals 374 and 376 straddle a pair of ports 380 radially extending through the inner tubular member 348 from inner diameter 378 to a polished outer diameter 382 of the inner tubular member. The ports 380 provide fluid communication between an annular chamber 384 and the inner flow passage 368 when the actuating rod 352 is moved axially downward relative to the inner tubular member 348 after the gun 340 fires and the gun release 336 releases as further described hereinbelow.

The annular chamber 384 extends radially between the outer diameter 382 of the inner tubular member 348 and a polished inner diameter 386 of an outer tubular member 388. Outer tubular member 388 is in a coaxial telescoping and overlapping relationship to the inner tubular member 348. Seal 412 is disposed in a circumferential groove 414 formed on a radially reduced upper portion 416 of the outer tubular member 388 and is in sealing engagement with the outer diameter 382 of the inner tubular member 348. Seal 418 is disposed in a circumferential groove 420 formed on a lower radially enlarged portion 422 of the inner tubular member 348 and is in sealing engagement with the inner diameter 386 of the outer tubular member 388.

The annular chamber 384 extends longitudinally between a shoulder 390 on the inner tubular member 348 to shoulders 392 and 394 on the outer tubular member 388. The annular chamber 384 is substantially filled with a substantially incompressible fluid 396, for example, oil or silicone fluid. The fluid 396 does not permit the outer tubular member 388 to move appreciably axially downward relative to the inner tubular member 348, and shoulder 408 on the inner tubular member 348, in contact with shoulder 410 on the outer tubular member, prevents the outer tubular member from moving upward relative to the inner tubular member. When, however, the ports 380 are no longer straddled by the seals 374 and 376, the fluid 396 may pass from the annular chamber 384, through the ports 380, and into the inner flow passage 368 and thereby permit the outer tubular member 388 to move axially downward relative to the inner tubular member 348.

FIG. 7A shows the tool string 342 positioned in the wellbore 398 with the guns 340 positioned longitudinally opposite a potentially productive formation 400 and the packer 330 set in protective casing 402. The function of the apparatus 326 in the illustrated embodiment is to position the screen 334 opposite the formation 400 automatically after the gun 340 has perforated the casing 402. The operation of the automatic gun release 336 in releasing all equipment attached below it after the gun 340 has fired is utilized to exert an axially downward pull on the actuator rod 352 and thereby uncover the ports 380 so that the outer tubular member 388 is permitted to move axially downward relative to inner tubular member 348.

Figure 7B:
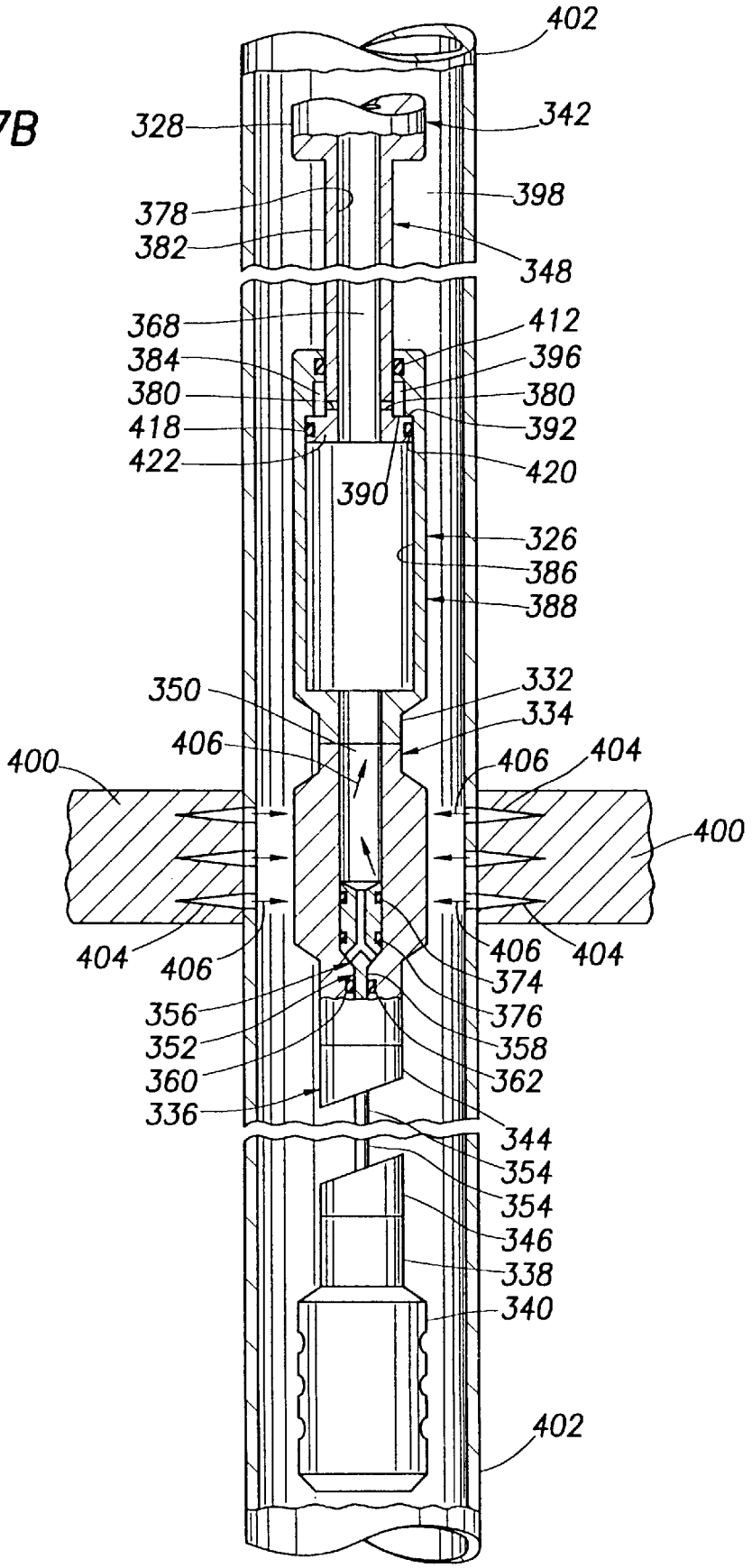
FIG. 7B is a schematicized partially cross-sectional view of the wellbore equipment positioning apparatus illustrated in FIG. 7A in an extended configuration thereof, and the method illustrated in FIG. 7A wherein the zone has been perforated and a screen positioned opposite the producing zone.

FIG. 7B shows the tool string 342, including the apparatus 326, shown in FIG. 7A in the wellbore 398 after the gun 340 has fired, forming perforations 404 which extend radially through the casing 402 and into the formation 400. Gun release 336 has released, permitting the lower portion 346, firing head 338, and gun 340 to drop longitudinally downward in the wellbore 398, causing a downward pull to be exerted on the lower portion 354 of the actuating rod 352.

Due to the downward pull on the actuating rod 352, head portion 356 has been moved axially downward such that it is no longer in the interior of the inner tubular member 348, but is in a lower portion of the bore 350 of the screen 334. Seals 374 and 376 no longer straddle the ports 380, therefore, fluid communication has been established between the annular chamber 384 and the inner flow passage 368. Substantially all of the fluid 396 has been forced out of the annular chamber 384 due to the annular chamber's decreased volume.

Shoulder 392 contacts shoulder 390, preventing further axially downward movement of the outer tubular member 388 relative to the inner tubular member 348. In the extended configuration of the apparatus 326 illustrated in FIG. 7B, the screen 334 is now positioned longitudinally opposite the formation 400 and formation fluids 406 may now flow directly from the formation, through the perforations 404, and into the bore 350 of the screen 334. Note that the screen 334 was positioned opposite the formation 400, displacing the gun 340, automatically after the gun was fired.

It is to be understood that although FIG. 7B shows the rod lower portion 354 remaining attached to the gun release lower portion 346, the rod lower portion 354 may be detached from the gun release lower portion 346, thereby allowing the gun 340, firing head 338, and gun release lower portion 346 to drop to the bottom of the wellbore 398, without deviating from the principles of the present invention. It is also to be understood that the rod lower portion 354 may be detached from the rod head portion 356 after the gun release 336 has released, thereby allowing the rod lower portion 354 to drop to the bottom of the wellbore 398 along with the gun 340, firing head 338, and gun release lower portion 346 without deviating from the principles of the present invention.

Figure 8A:
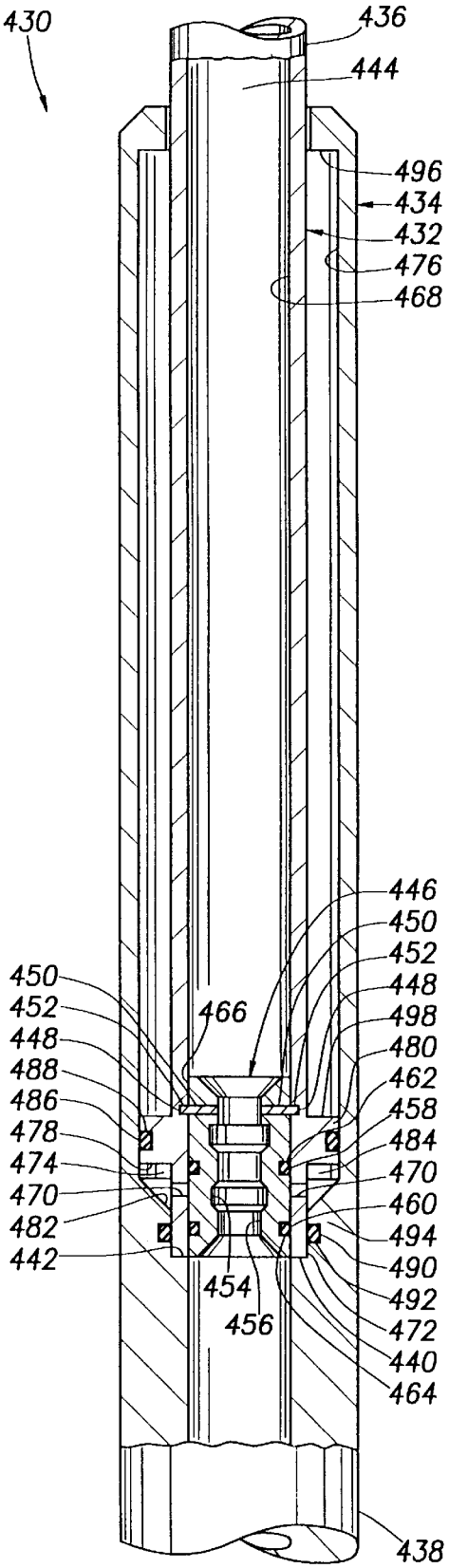
FIG. 8A is a schematicized partially cross-sectional view of a seventh wellbore equipment positioning apparatus embodying principles of the present invention in a compressed configuration thereof.

Illustrated in FIG. 8A is an apparatus 430 for positioning equipment in a wellbore. The apparatus 430 includes inner and outer coaxial telescoping tubular members, 432 and 434 respectively. As shown in FIG. 8A, the apparatus 430 is configured in an axially compressed position wherein the outer tubular member 434 substantially overlaps the inner tubular member 432. In the compressed position, the distance between upper end portion 436 and lower end portion 438 of the apparatus 430 is minimized. The upper end portion 436 is preferably attached to a device for preventing axial movement of the apparatus 430 in the wellbore, such as a packer, and lower end portion 438 is preferably attached to the equipment. Shoulder 440 on the outer tubular member 434, in contact with shoulder 442 on the inner tubular member 432, prevents further axial compression of the apparatus 430.

Axial flow passage 444 extends through the apparatus 430 providing fluid and pressure communication between the upper end portion 436 and the lower end portion 438. A tubular sliding sleeve 446 axially disposed within the flow passage 444 is secured to the inner tubular member 432 by means of shear pins 448. Each of the shear pins 448 are installed in holes 450, which extend radially through the sliding sleeve 446, and holes 452, which extend radially into, but not through, the inner tubular member 432. A conventional latching profile 454 is formed on inner diameter 456 of the sliding sleeve 446, so that a conventional latching tool (not shown) may be latched into the latching profile 454 in order to apply a predetermined axial force to the shifting sleeve 446 to shear the shear pins 448.

Seals 458 and 460 are disposed in longitudinally spaced apart circumferential grooves, 462 and 464 respectively, formed on outer diameter 466 of the sliding sleeve 446, and sealingly engage a polished inner diameter 468 of the inner tubular member 432. Seals 458 and 460 straddle ports 470 and prevent fluid communication between the ports and the flow passage 444. Ports 470 extend radially through the inner tubular member 432 from inner diameter 468 to a polished outer diameter 472 of the inner tubular member.

The ports 470 are in fluid communication with an annular chamber 474. The annular chamber 474 extends radially from outer diameter 472 of the inner tubular member 432 to a polished inner diameter 476 of the outer tubular member 434. The annular chamber 474 extends longitudinally from shoulder 478 on a radially enlarged portion 480 of inner tubular member 432 to radially extending and longitudinally sloping shoulder 482 on the outer tubular member 434. A substantially inexpandable fluid 484 substantially fills the annular chamber 474.

Seal 486, disposed in circumferential groove 488 formed on the radially enlarged portion 480 of the inner tubular member 432, sealingly contacts the inner diameter 476 of the outer tubular member 434. Seal 490, disposed in circumferential groove 492 formed on radially reduced portion 494 of the outer tubular member 434, sealingly contacts the outer diameter 472 of the inner tubular member 432.

The outer tubular member 434 is not permitted to move appreciably axially downward relative to the inner tubular member 432 because such movement would require an increase in the volume of the annular chamber 474. Since the annular chamber 474 is sealed and the fluid 484 therein is substantially inexpandable, the volume of the annular chamber cannot be appreciably increased. When, however, the shear pins 448 are sheared and the sliding sleeve 446 is axially displaced such that seals 458 and 460 no longer straddle the ports 470, the annular chamber 474 is in fluid communication with the flow passage 444 and fluid may enter the annular chamber 474 so that it is permitted to expand.

Figure 8B:
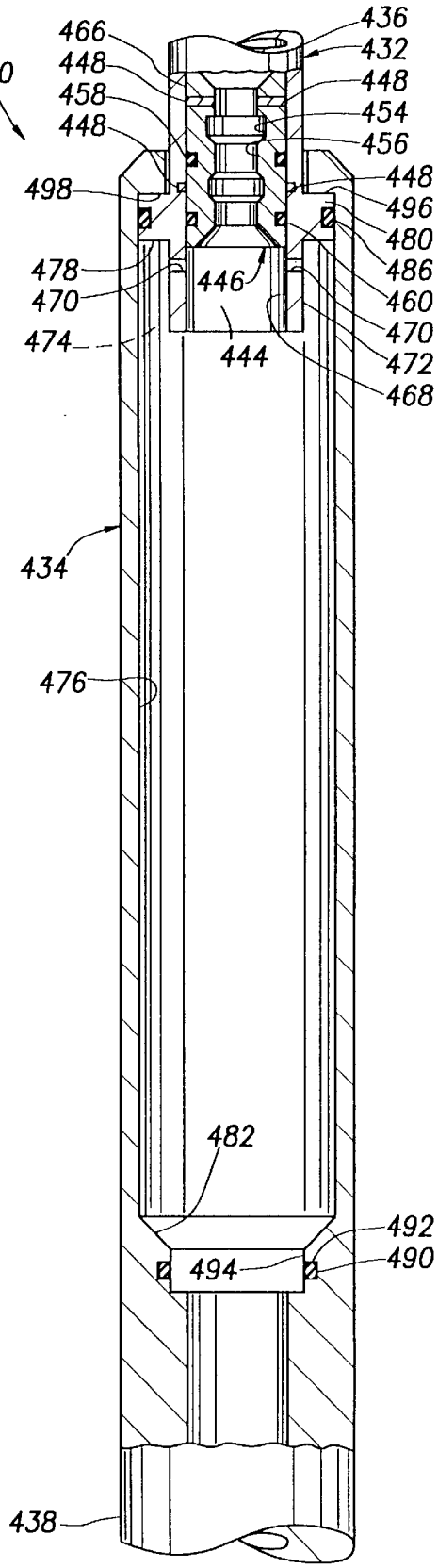
FIG. 8B is a schematicized partially cross-sectional view of the apparatus illustrated in FIG. 8A in an extended configuration thereof.

FIG. 8B shows the apparatus 430 illustrated in FIG. 8A in an extended configuration thereof. A latching tool (not shown) has been latched into the latching profile 454 in the sliding sleeve 446 and the predetermined forced applied to shear the shear pins 448 and move the sliding sleeve axially upward so that seals 458 and 460 no longer straddle the ports 470.

Fluid communication has been established between the flow passage 444 and the ports 470, thereby permitting the annular chamber 474 to expand volumetrically. Outer diameter 472 of inner tubular member 432 is no longer within the reduced portion 494 of the outer tubular member 434, therefore, the outer diameter 472 no longer forms a boundary of the annular chamber 474 and the annular chamber essentially ceases to exist.

The outer tubular member 434 is permitted to move axially downward relative to the inner tubular member 432 until shoulder 496 on the outer tubular member contacts shoulder 498 on the inner tubular member. The equipment attached to the lower end portion 438 is thus moved longitudinally downward in the wellbore relative to the upper end portion 436 of the apparatus 430.

For purposes which will become apparent upon consideration of the written description accompanying FIGS. 13A–13C and 14A–14B, outer tubular member 434 may alternatively be perforated such that fluid communication is established between flow passage 444 and the wellbore after inner tubular member 432 is axially extended. Such perforation of outer tubular member 434 should preferably be above the seal 486.

It is to be understood that, although various embodiments of apparatus for positioning equipment in a wellbore described hereinabove which include a release mechanism actuatable by pressure applied to an inner flow passage above a ball are not also illustrated as including a latching profile for mechanical actuation of the release mechanism, such inclusion of a latching profile in each of the disclosed embodiments is contemplated by the inventors. An embodiment of the present invention having a release mechanism which is actuatable by both direct application of force via a latching tool latched into a latching profile and by application of pressure after installing a ball is specifically illustrated in FIGS. 1A and 1B. Therefore, a latching profile for mechanical actuation of the release mechanism may be included in each of the above disclosed embodiments without departing from the principles of the present invention.

Thus have been described several positioning devices useful for positioning equipment in subterranean wellbores. The remainder of the detailed description set forth hereinbelow is directed to various embodiments of methods of completeing wells utilizing wellbore equipment positioning apparatus.

Each of the accompanying figures representatively illustrating the various methods is drawn as if the wellbore is vertical. Consequently, the upward direction shall be used to indicate a direction toward the top of the drawing page and the downward direction shall be used to indicate a direction toward the bottom of the drawing page. It is to be understood, however, that the present invention in each of its embodiments is operative whether oriented vertically, horizontally, or inclined in relation to a horizontal or vertical axis.

Figure 9A:
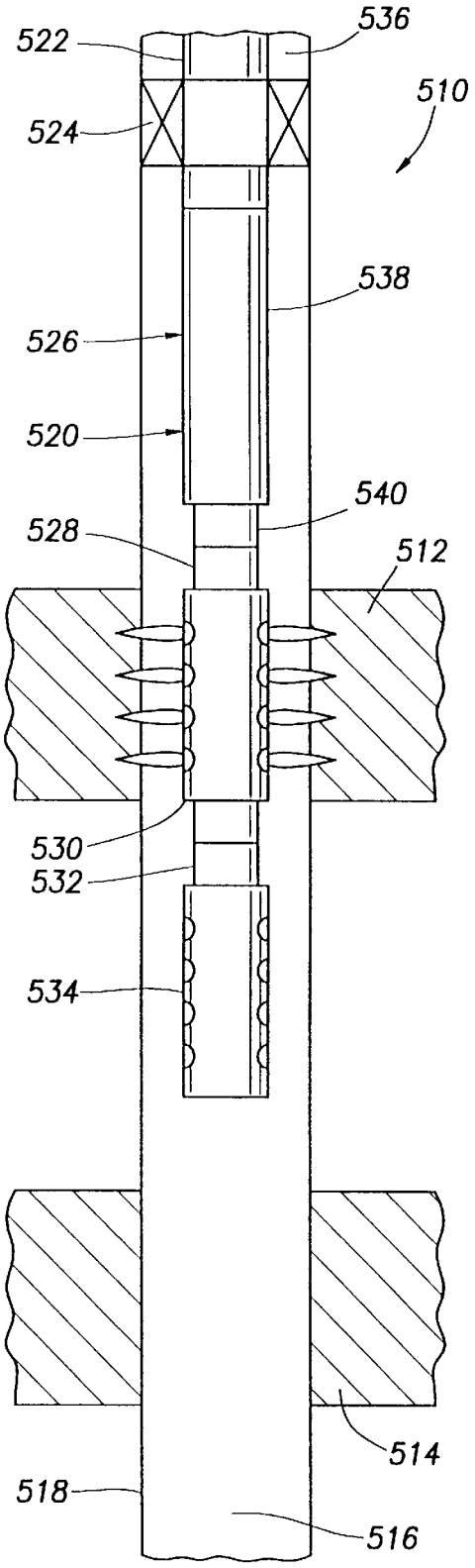
FIG. 9A is a highly schematicized partially cross-sectional view of a third method of completing a subterranean well having upper and lower zones to be produced, with the upper zone being perforated.
Figure 9B:
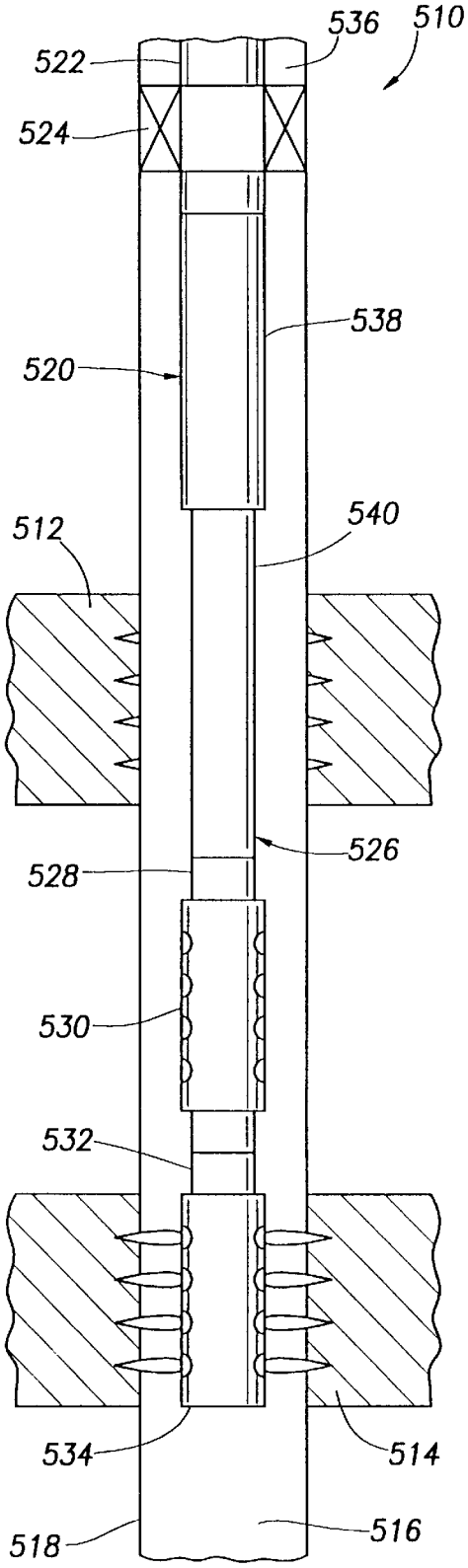
FIG. 9B is a highly schematicized partially cross-sectional view of the third method, with the lower zone being perforated.

Illustrated in FIGS. 9A and 9B is a method 510 of completing a subterranean well. The well has two potentially productive zones, an upper zone 512 and a lower zone 514, intersected by a wellbore 516 which has been lined with protective casing 518.

A completion tool string 520 is lowered into the wellbore 516, suspended from production tubing 522. The tool string 520 includes, from the production tubing 522 downward, a packer 524, a wellbore equipment positioning device 526, an upper set of conventional production equipment 528, upper perforating gun 530, a lower set of conventional production equipment 532, and a lower perforating gun 534.

The packer 524 is set in the casing 518, isolating the wellbore 516 above the packer in annulus 536 between the tubing 522 and the casing 518 from the wellbore below the packer. When the packer 524 is set in the casing 518, the upper perforating gun 530 is opposite the upper zone 512.

Perforating guns 530 and 534 are conventional and are typically configured so that their axial lengths correspond to the lengths of the zones 512 and 514, respectively, intersected by the wellbore 516. Each of perforating guns 530 and 534 may be made up of more than one individual gun sections which are joined together to achieve a desired length. It is to be understood that alternate types of perforating guns may be utilized in the representatively illustrated method 510 without departing from the principles of the present invention.

The upper and lower sets of production equipment 528 and 532 may typically include lengths of tubing, firing heads, valves, gun releases, and other conventional items of equipment. Additionally, specialized equipment may also be used, such as tools for acidizing, fracturing, gravel packing, etc. Different items of equipment may be utilized in the upper and lower sets of production equipment 528 and 532 without departing from the principles of the present invention.

The positioning device 526 may include any of those devices 10, 100, 170, 240, 306, 326, and 430 shown in FIGS. 1A, 2A, 3A, 5A, 6, 7A, and 8A, respectively. If one of devices 10, 100, or 170, shown in FIGS. 1A, 2A, or 3A, respectively, is utilized for the positioning device 526, upper tubular member 538 of the positioning device 526 will correspond to outer tubular member 12, and lower tubular member 540 of the positioning device 526 will correspond to inner tubular member 14. If one of devices 240 or 306, shown in FIGS. 5A or 6, respectively, is utilized for the positioning device 526, upper tubular member 538 will correspond to outer tubular member 244 and lower tubular member 540 will correspond to inner tubular member 242. If device 326, shown in FIG. 7A, is utilized for the positioning device 526, upper tubular member 538 will correspond to inner tubular member 348 and lower tubular member 540 will correspond to outer tubular member 388. If device 430, shown in FIG. 8A, is utilized for the positioning device 526, upper tubular member 538 will correspond to inner tubular member 432 and lower tubular member 540 will correspond to outer tubular member 434.

Positioning device 526 is lowered into the wellbore 516, as representatively illustrated in FIG. 9A, in a compressed configuration thereof. With the positioning device 526 in its compressed configuration and the packer 524 set, the upper perforating gun 530 is in position to perforate the upper zone 512.

After the packer 524 is set in the casing 518, the upper perforating gun 530 is fired, perforating the upper zone 512 as shown in FIG. 9A. The positioning device 526 is then extended, positioning lower perforating gun 534 opposite the lower zone 514. The lower perforating gun 534 is then fired, perforating the lower zone 514 as shown in FIG. 9B.

It will be readily apparent to one of ordinary skill in the art that the lower perforating gun 534 may be utilized to perforate the upper zone 512 and the upper perforating gun 530 may be utilized to perforate the lower zone 514. This could be accomplished by, for example, positioning the lower perforating gun 534 opposite the upper zone 512, setting the packer 524 in the casing 518, firing the lower perforating gun to perforate the upper zone, extending the positioning device 526 to position the upper perforating gun 530 opposite the lower zone 514, and firing the upper perforating gun to perforate the lower zone.

Thus has been described the method 510 whereby more than one zone 512, 514 may be perforated without having to unset the packer 524 and without having to space out the perforating guns 530, 534 to match the longitudinal spacing of the zones when the tool string 520 is lowered into the wellbore 516. This result is accomplished if in the method 510 by utilizing a single positioning device 526. Multiple positioning devices may also be used as described in further detail below.

Figure 10A:
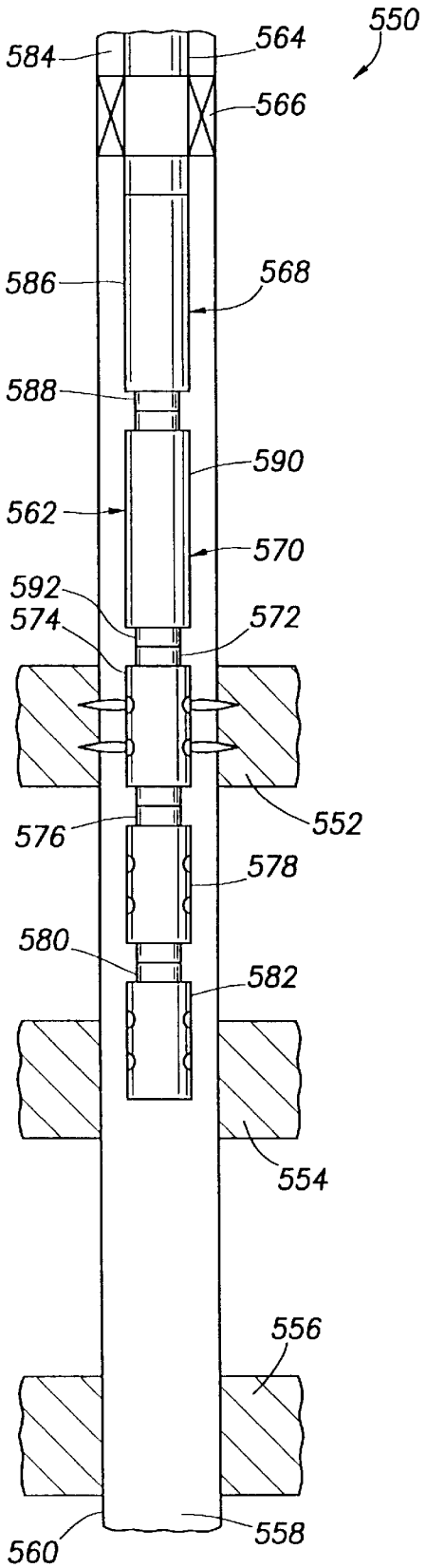
FIG. 10A is a highly schematicized partially cross-sectional view of a fourth method of completing a subterranean well having upper, intermediate, and lower zones to be produced, with the upper zone being perforated.
Figure 10B:
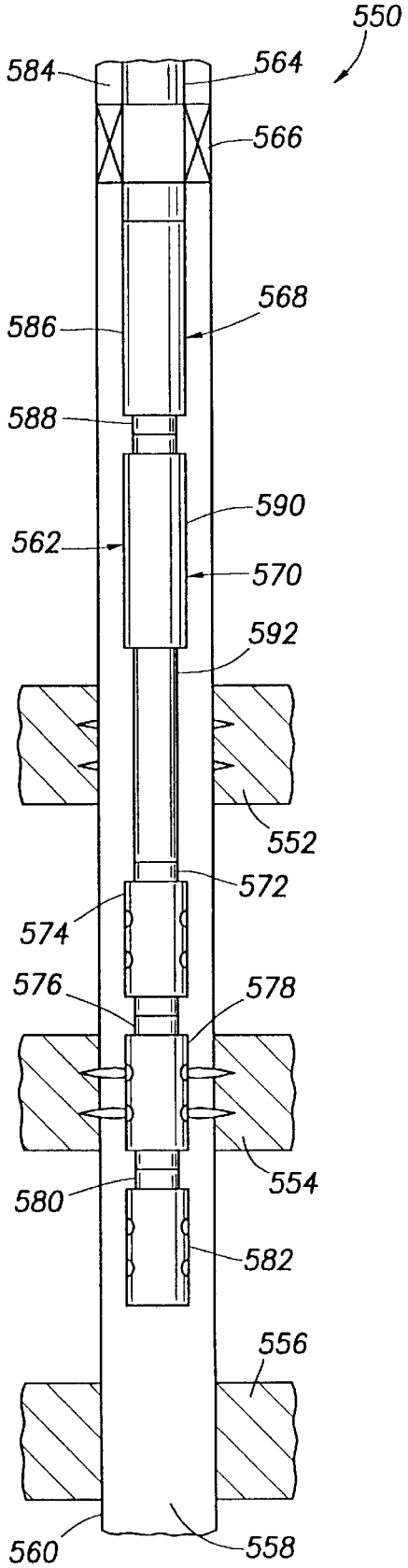
FIG. 10B is a highly schematicized partially cross-sectional view of the fourth method, with the intermediate zone being perforated.
Figure 10C:
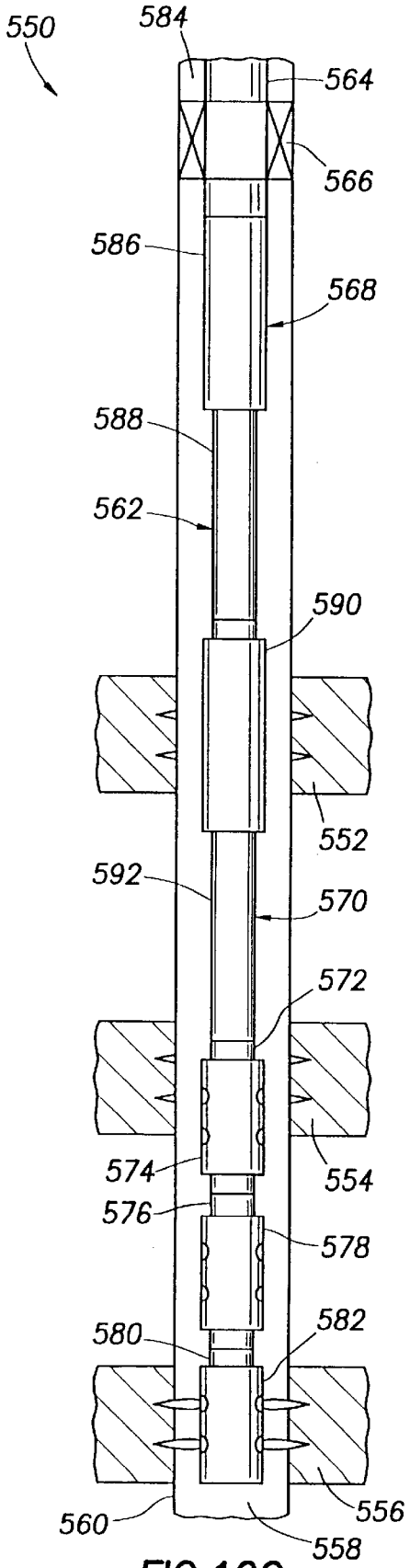
FIG. 10C is a highly schematicized partially cross-sectional view of the fourth method, with the lower zone being perforated.

Shown in FIGS. 10A–10C is a method 550 of completing a subterranean well. The well has three potentially productive zones, an upper zone 552, an intermediate zone 554, and a lower zone 556, intersected by a wellbore 558 which has been lined with protective casing 560.

A completion tool string 562 is lowered into the wellbore 558, suspended from production tubing 564. The tool string 562 includes, from the production tubing 564 downward, a packer 566, an upper wellbore equipment positioning device 568, a lower wellbore equipment positioning device 570, an upper set of conventional production equipment 572, upper perforating gun 574, an intermediate set of conventional production equipment 576, intermediate perforating gun 578, a lower set of conventional production equipment 580, and a lower perforating gun 582.

The packer 566 is set in the casing 560, isolating the wellbore 558 above the packer in annulus 584 between the tubing 564 and the casing 560 from the wellbore below the packer. When the packer 566 is set in the casing 560, the upper perforating gun 574 is opposite the upper zone 552.

Perforating guns 574, 578, and 582 are conventional and are typically configured so that their axial lengths correspond to the lengths of the zones 552, 554, and 556, respectively, intersected by the wellbore 558. Each of perforating guns 574, 578, and 582 may be made up of more than one individual gun sections which are joined together to achieve a desired length. It is to be understood that alternate types of perforating guns may be utilized in the representatively illustrated method 550 without departing from the principles of the present invention.

The upper, intermediate, and lower sets of production equipment 572, 576, and 580 may typically include lengths of tubing, firing heads, valves, gun releases, and other conventional items of equipment. Additionally, specialized equipment may also be used, such as tools for acidizing, fracturing, gravel packing, etc. Different items of equipment may be utilized in the upper, intermediate, and lower sets of production equipment 572, 576, and 580 without departing from the principles of the present invention.

The positioning devices 568 and 570 may include any of those devices 10, 100, 170, 240, 306, 326, and 430 shown in FIGS. 1A, 2A, 3A, 5A, 6, 7A, and 8A, respectively. If one of devices 10, 100, or 170, shown in FIGS. 1A, 2A, or 3A, respectively, is utilized for positioning device 568 or 570, upper tubular member 586 or 590 of the positioning device 568 or 570, respectively, will correspond to outer tubular member 12, and lower tubular member 588 or 592 of the positioning device 568 or 570, respectively, will correspond to inner tubular member 14. If one of devices 240 or 306, shown in FIGS. 5A or 6, respectively, is utilized for positioning device 568 or 570, upper tubular member 586 or 590, respectively, will correspond to outer tubular member 244 and lower tubular member 588 or 592, respectively, will correspond to inner tubular member 242. If device 326, shown in FIG. 7A, is utilized for positioning device 568 or 570, upper tubular member 586 or 590, respectively, will correspond to inner tubular member 348 and lower tubular member 588 or 592, respectively, will correspond to outer tubular member 388. If device 430, shown in FIG. 8A, is utilized for positioning device 568 or 570, upper tubular member 586 or 590, respectively, will correspond to inner tubular member 432 and lower tubular member 588 or 592, respectively will correspond to outer tubular member 434.

Positioning devices 568 and 570 are lowered into the wellbore 558, as representatively illustrated in FIG. 10A, in a compressed configuration thereof. With the positioning devices 568 and 570 in their compressed configurationd and the packer 566 set, the upper perforating gun 574 is in position to perforate the upper zone 552.

After the packer 566 is set in the casing 560, the upper perforating gun 574 is fired, perforating the upper zone 552 as shown in FIG. 10A. The positioning device 570 is then extended, positioning the intermediate perforating gun 578 opposite the intermediate zone 554. The intermediate perforating gun 578 is fired, perforating the intermediate zone 554 as shown in FIG. 10B. The positioning device 568 is then extended, positioning the lower perforating gun 582 opposite the lower zone 556. The lower perforating gun 582 is fired, perforating the lower zone 556 as shown in FIG. 10C.

It will be readily apparent to one of ordinary skill in the art that the perforating guns 574, 578, and 582 may be utilized to perforate the zones 552, 554, and 556, in other sequences. For example upper perforating gun 574 may be used to perforate intermediate zone 554 after intermediate perforating gun 578 has been used to perforate upper zone 552.

It will also be readily apparent to one of ordinary skill in the art that either of the positioning devices 568 or 570 may be extended first. Where, however, the positioning devices 568 and 570 are to be extended utilizing a plugging device such as a ball (for example ball 78 shown in FIGS. 1A, 2A, and 3A, and ball 296 shown in FIG. 5A), the plugging device used in extending the lower positioning device 570 should be small enough to pass through the upper positioning device 568 if it is to be dropped through the tubing 564. Preferably, the plugging device used in extending the upper positioning device 568 is larger than the plugging device used in extending the lower positioning device 570.

It is to be understood that any combination of the devices 10, 100, 170, 240, 306, 326, and 430 shown in FIGS. 1A, 2A, 3A, 5A, 6, 7A, and 8A may be utilized for the positioning devices 568 and 570. Any of the above listed devices may also be the upper or lower positioning device 568 or 570 as well. Preferably, however, device 326 shown in FIG. 7A, if utilized, should be the lower positioning device 570 since device 326 is extended in response to a perforating gun being fired.

Thus has been described the method 550 whereby more than two zones 552, 554, and 556 may be perforated without having to unset the packer 566 and without having to space out the perforating guns 574, 578, and 582 to match the longitudinal spacing of the zones when the tool string 562 is lowered into the wellbore 558. This result is accomplished in the method 550 by utilizing multiple positioning devices 568, 570 between the packer 566 and the perforating guns 574, 578, and 582. Positioning devices may also be used between perforating guns as described in further detail below.

Figure 11A:
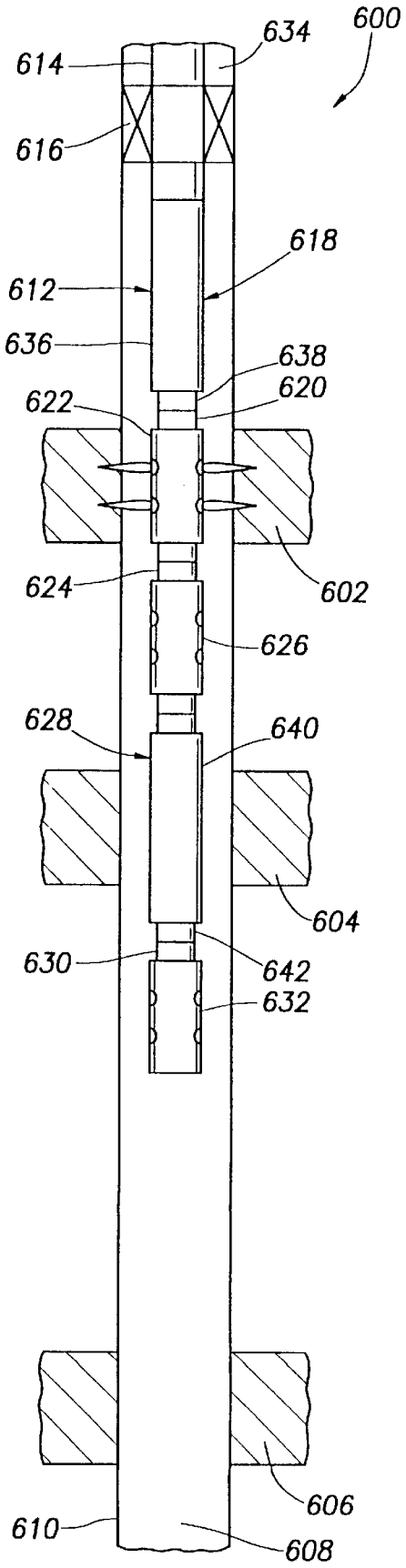
FIG. 11A is a highly schematicized partially cross-sectional view of a fifth method of completing a subterranean well having upper, intermediate, and lower zones to be produced, with the upper zone being perforated.
Figure 11B:
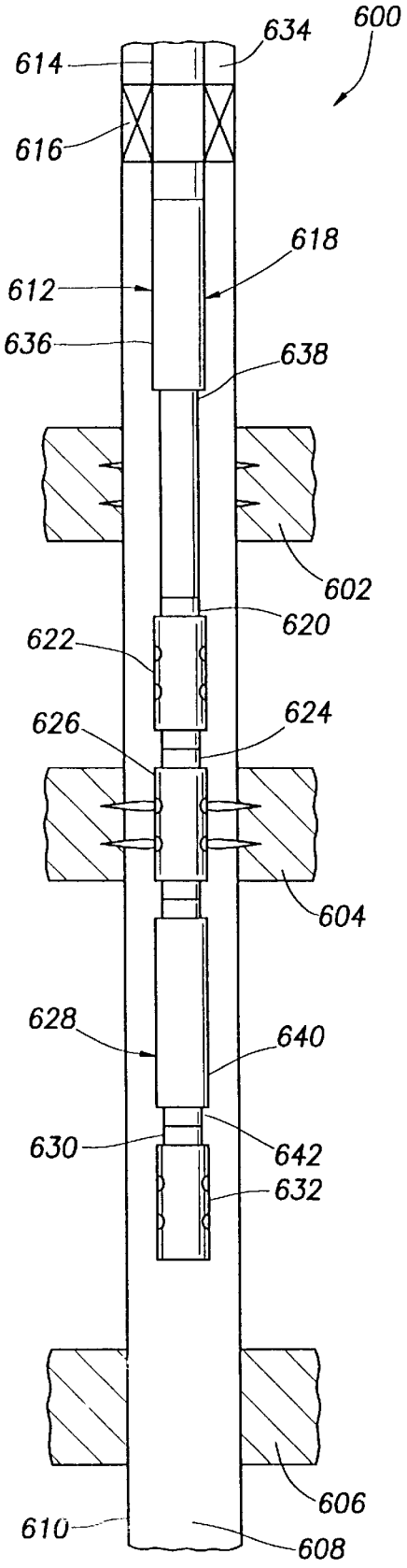
FIG. 11B is a highly schematicized partially cross-sectional view of the fifth method, with the intermediate zone being perforated.
Figure 11C:
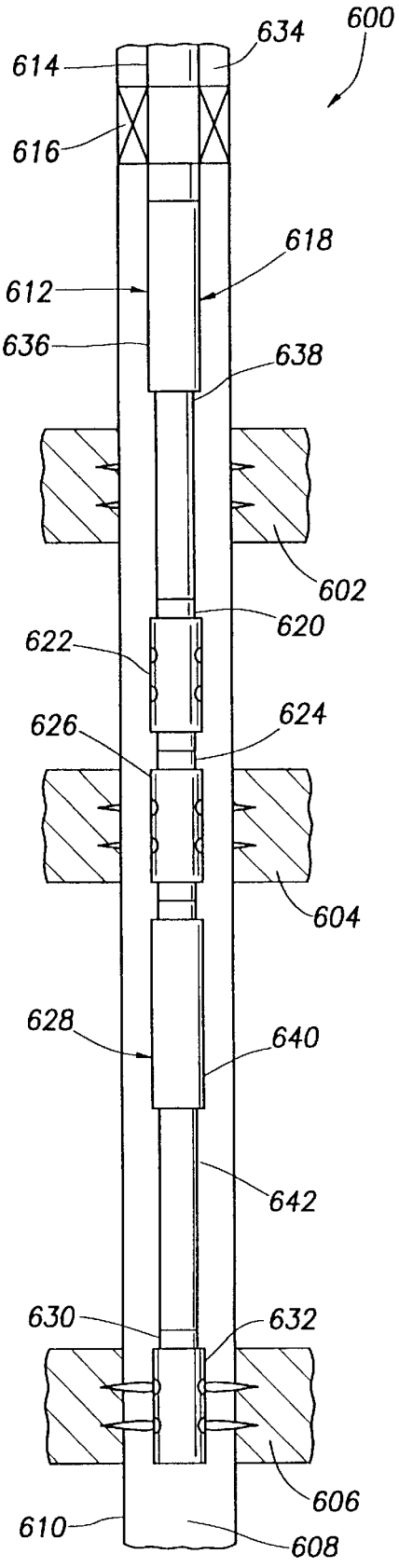
FIG. 11C is a highly schematicized partially cross-sectional view of the fifth method, with the lower zone being perforated.

Turning now to FIGS. 11A–11C a method 600 of completing a subterranean well is representatively illustrated. The well has three potentially productive zones, an upper zone 602, an intermediate zone 604, and a lower zone 606, intersected by a wellbore 608 which has been lined with protective casing 610.

A completion tool string 612 is lowered into the wellbore 608, suspended from production tubing 614. The tool string 612 includes, from the production tubing 614 downward, a packer 616, an upper wellbore equipment positioning device 618, an upper set of conventional production equipment 620, upper perforating gun 622, an intermediate set of conventional production equipment 624, intermediate perforating gun 626, a lower wellbore equipment positioning device 628, a lower set of conventional production equipment 630, and a lower perforating gun 632.

The packer 616 is set in the casing 610, isolating the wellbore 608 above the packer in annulus 634 between the tubing 614 and the casing 610 from the wellbore below the packer. When the packer 616 is set in the casing 610, the upper perforating gun 622 is opposite the upper zone 602.

Perforating guns 622, 626, and 632 are conventional and are typically configured so that their axial lengths correspond to the lengths of the zones 602, 604, and 606, respectively, intersected by the wellbore 608. Each of perforating guns 622, 626, and 632 may be made up of more than one individual gun sections which are joined together to achieve a desired length. It is to be understood that alternate types of perforating guns may be utilized in the representatively illustrated method 600 without departing from the principles of the present invention.

The upper, intermediate, and lower sets of production equipment 620, 624, and 630 may typically include lengths of tubing, firing heads, valves, gun releases, and other conventional items of equipment. Additionally, specialized equipment may also be used, such as tools for acidizing, fracturing, gravel packing, etc. Different items of equipment may be utilized in the upper, intermediate, and lower sets of production equipment 620, 624, and 630 without departing from the principles of the present invention.

Upper positioning device 618 may include any of those devices 10, 100, 170, 240, 306, 326, and 430 shown in FIGS. 1A, 2A, 3A, 5A, 6, 7A, and 8A, respectively. If one of devices 10, 100, or 170, shown in FIGS. 1A, 2A, or 3A, respectively, is utilized for positioning device 618, upper tubular member 636 of the positioning device 618 will correspond to outer tubular member 12, and lower tubular member 638 of the positioning device 618 will correspond to inner tubular member 14. If one of devices 240 or 306, shown in FIGS. 5A or 6, respectively, is utilized for positioning device 618, upper tubular member 636 will correspond to outer tubular member 244 and lower tubular member 638 will correspond to inner tubular member 242. If device 326, shown in FIG. 7A, is utilized for positioning device 618, upper tubular member 636 will correspond to inner tubular member 348 and lower tubular member 638 will correspond to outer tubular member 388. If device 430, shown in FIG. 8A, is utilized for positioning device 618, upper tubular member 636 will correspond to inner tubular member 432 and lower tubular member 638 will correspond to outer tubular member 434.

Lower positioning device 628 may include device 326, shown in FIG. 7A. If device 326 is utilized for positioning device 628, upper tubular member 640 will correspond to outer tubular member 388 and lower tubular member 642 will correspond to inner tubular member 348. Note that in this orientation, the device 326 will be inverted vertically from that shown in FIG. 7A. It is to be understood that lower positioning device 628 could also be disposed between upper perforating gun 622 and intermediate perforating gun 626 without departing from the principles of the present invention.

Positioning devices 618 and 628 are lowered into the wellbore 608, as representatively illustrated in FIG. 11A, in a compressed configuration thereof. With the positioning devices 618 and 628 in their compressed configurations and the packer 616 set, the upper perforating gun 622 is in position to perforate the upper zone 602.

After the packer 616 is set in the casing 610, the upper perforating gun 622 is fired, perforating the upper zone 602 as shown in FIG. 11A. The upper positioning device 618 is then extended, positioning the intermediate perforating gun 626 opposite the intermediate zone 604. The intermediate perforating gun 626 is fired, perforating the intermediate zone 604 as shown in FIG. 11B. The positioning device 628 is then extended, positioning the lower perforating gun 632 opposite the lower zone 606. The lower perforating gun 632 is fired, perforating the lower zone 606 as shown in FIG. 11C.

It will be readily apparent to one of ordinary skill in the art that the perforating guns 622, 626, and 632 may be utilized to perforate the zones 602, 604, and 606, in other sequences. It will also be readily apparent to one of ordinary skill in the art that either of the positioning devices 618 or 628 may be extended first.

Thus has been described the method 600 whereby more than two zones 602, 604, and 606 may be perforated without having to unset the packer 616 and without having to space out the perforating guns 622, 626, and 632 to match the spacing of the zones when the tool string 612 is lowered into the wellbore 608. This result is accomplished in the method 600 by utilizing multiple positioning devices, an upper positioning device 618 between the packer 616 and the upper perforating gun 622, and a lower positioning device 628 between the intermediate perforating gun 626 and the lower perforating gun 632. Positioning devices may also be used to position equipment other than perforating guns and sand screens within a wellbore as described in further detail below.

Figure 12A:
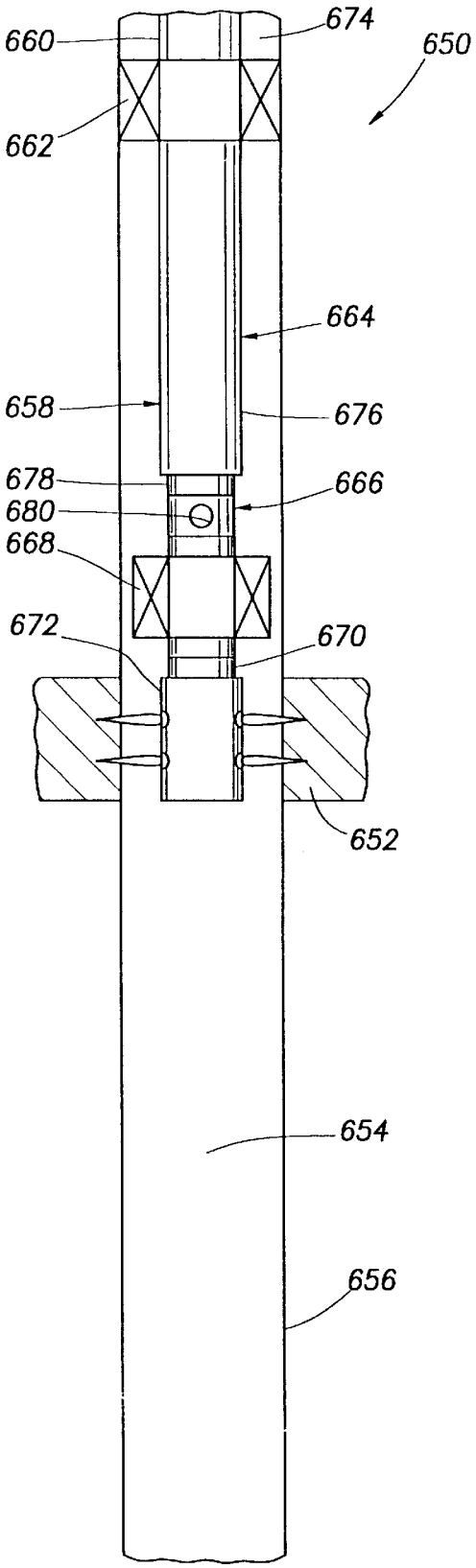
FIG. 12A is a highly schematicized partially cross-sectional view of a sixth method of completing a subterranean well, with a zone to be produced being perforated.
Figure 12B:
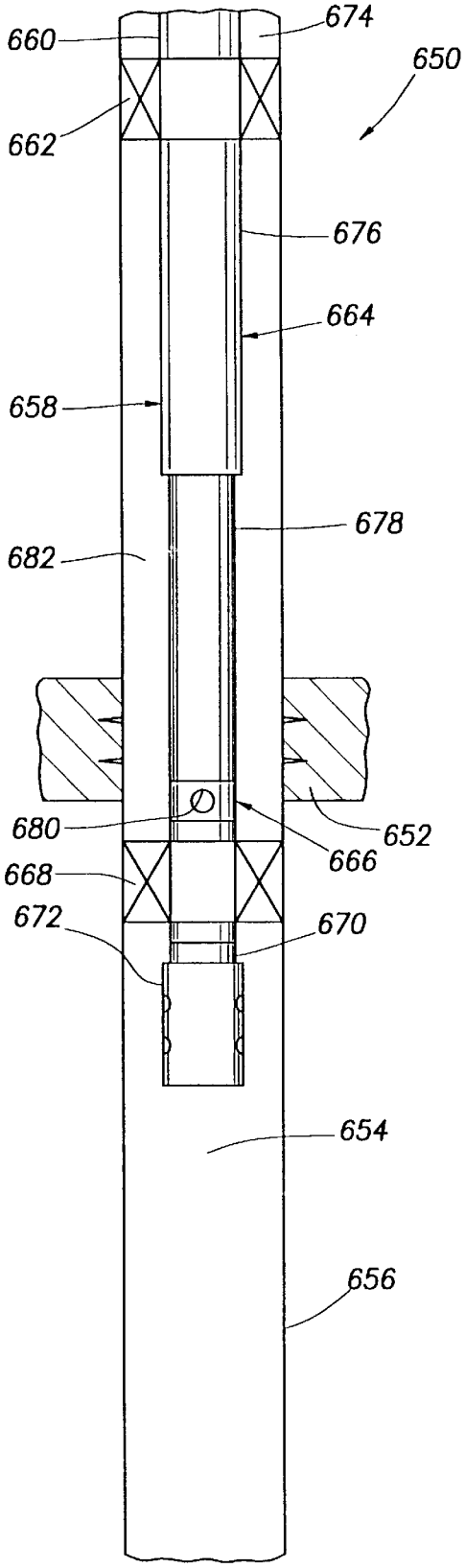
FIG. 12B is a highly schematicized partially cross-sectional view of the sixth method, with an isolation packer set below the perforated zone.

Illustrated in FIGS. 12A and 12B is a method 650 of completing a subterranean well. The well has a potentially productive zone 652 intersected by a wellbore 654 which has been lined with protective casing 656. The method 650 is useful where it is desired to isolate the zone 652 from other zones elsewhere in the wellbore 654, or from the remainder of the wellbore, after the zone 652 has been perforated. For example, zone 652 may be isolated after perforating so that a sample may be brought to the surface of the fluids present in the zone, so that characteristics of the zone such as flow rate may be tested, so that fluids such as acidizing agents may be pumped into the zone, so that the zone may be fractured, etc.

A completion tool string 658 is lowered into the wellbore 654, suspended from production tubing 660. The tool string 658 includes, from the production tubing 660 downward, an upper packer 662, a wellbore equipment positioning device 664, a conventional production valve 666, a lower packer 668, a set of conventional production equipment 670, and a perforating gun 672.

The upper packer 662 is set in the casing 656, isolating the wellbore 654 above the packer 662 in upper annulus 674 between the tubing 660 and the casing 656 from the wellbore below the packer 662. When the packer 662 is set in the casing 656, the perforating gun 672 is opposite the zone 652.

Perforating gun 672 is conventional and is typically configured so that its axial length corresponds to the length of the zone 652 intersected by the wellbore 654. The perforating gun 672 may be made up of more than one individual gun sections which are joined together to achieve a desired length. It is to be understood that alternate types of perforating guns may be utilized in the representatively illustrated method 650 without departing from the principles of the present invention.

The production equipment 670 may typically include lengths of tubing, firing heads, valves, gun releases, and other conventional items of equipment. Additionally, specialized equipment may also be used, such as tools for acidizing, fracturing, gravel packing, etc. Different items of equipment may be utilized in the production equipment 670 without departing from the principles of the present invention.

The positioning device 664 may include any of those devices 10, 100, 170, 240, 306, 326, and 430 shown in FIGS. 1A, 2A, 3A, 5A, 6, 7A, and 8A, respectively. If one of devices 10, 100, or 170, shown in FIGS. 1A, 2A, or 3A, respectively, is utilized for the positioning device 664, upper tubular member 676 of the positioning device 664 will correspond to outer tubular member 12, and lower tubular member 678 of the positioning device 664 will correspond to inner tubular member 14. If one of devices 240 or 306, shown in FIGS. 5A or 6, respectively, is utilized for the positioning device 664, upper tubular member 676 will correspond to outer tubular member 244 and lower tubular member 678 will correspond to inner tubular member 242. If device 326, shown in FIG. 7A, is utilized for the positioning device 664, upper tubular member 676 will correspond to inner tubular member 348 and lower tubular member 678 will correspond to outer tubular member 388. If device 430, shown in FIG. 8A, is utilized for the positioning device 664, upper tubular member 676 will correspond to inner tubular member 432 and lower tubular member 678 will correspond to outer tubular member 434.

The production valve 666 is of the type typically used to alternately prevent and permit fluid communication between the wellbore 654 external to the tool string 658 and the interior of the tool string 658. This is accomplished by selectively opening and closing port 680. Preferably, the production valve 666 is of the type having an internal sliding sleeve, movable by means of a shifting tool lowered down through the tubing 660 on a wireline or slickline, allowing the opening and closing of the port 680 to be controlled from the earth's surface. It is to be understood that other valves may be utilized without departing from the principles of the present invention.

The lower packer 668 is preferably of the type which is releasable and is settable using hydraulic pressure. Pressure may be applied to the lower packer 668 by closing production valve 666 and applying pressure to the tubing 660 at the earth's surface. It is to be understood that other packers may be utilized without departing from the principles of the present invention.

Positioning device 664 is lowered into the wellbore 654, as representatively illustrated in FIG. 12A, in a compressed configuration thereof. With the positioning device 664 in its compressed configuration and the upper packer 662 set, the perforating gun 672 is in position to perforate the zone 652.

After the upper packer 662 is set in the casing 656, the perforating gun 672 is fired, perforating the zone 652 as shown in FIG. 12A. The positioning device 664 is then extended and the production valve 666 is closed as shown in FIG. 12B. Pressure is applied to the lower packer 668 to set the packer 668 in the casing 656 below the zone 652 and isolate the wellbore 654 in annulus 682 between the tool string 658 and the casing 656 and axially intermediate the upper and lower packers 662 and 668.

Annulus 682 is, thus, isolated at this point from the annulus 674 above the upper packer 662 and from the wellbore 654 below the lower packer 668. Production valve 666 is then opened so that fluid from the perforated zone 652 may be brought to the earth's surface through the tubing 660, or so that fluids may be pumped into the perforated zone 652 (such as acidizing, fracturing, or gravel packing fluids).

Thus has been described the method 650 whereby a zone 652 may be perforated and then isolated from the remainder of the wellbore 654 without having to unset the upper packer 662. This result is accomplished in the method 650 by utilizing a positioning device 664 between upper and lower packers 662 and 668, the lower packer 668 being positioned and set below the zone 652 after it has been perforated.

Figures 13A, 13B, 13C:
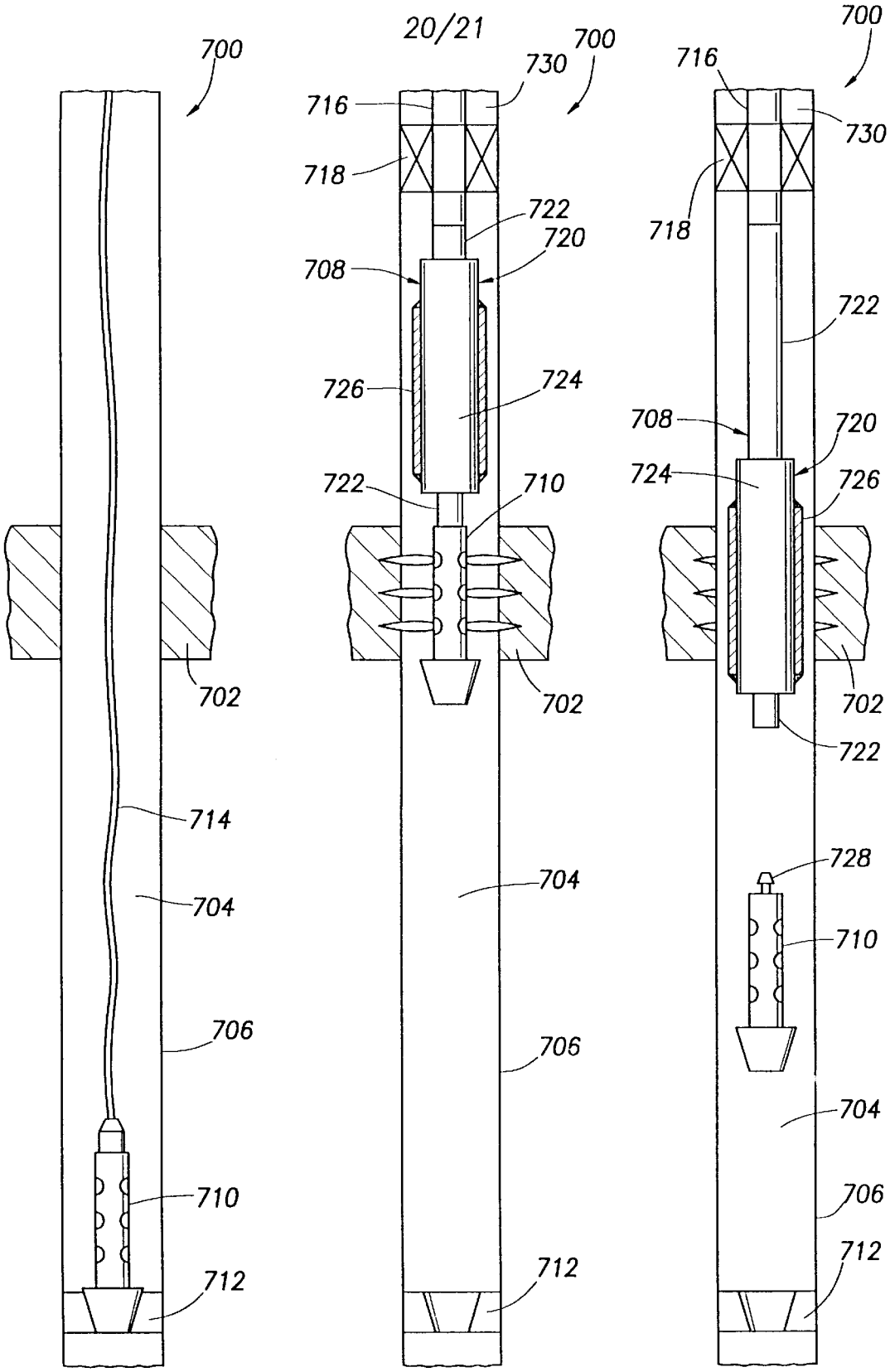
FIG. 13A is a highly schematicized partially cross-sectional view of a seventh method of completing a subterranean well, with a perforating gun being placed on a gun hanger below a zone to be produced.
FIG. 13B is a highly schematicized partially cross-sectional view of the seventh method, with the perforating gun positioned opposite the zone to be produced, and the zone being perforated.
FIG. 13C is a highly schematicized partially cross-sectional view of the seventh method, with a sand control screen positioned opposite the producing zone.

Shown in FIGS. 13A–13C is a method 700 of completing a subterranean well. The well has a potentially productive zone 702 intersected by a wellbore 704 in which protective casing 706 has been installed. Method 700 is useful where it is desired to run a completion tool string 708 into the wellbore 704 separate from a perforating gun 710. Such situations occur, for example, when the well cannot be "killed" during insertion of equipment into the well (i.e., equipment must be "lubricated" into the well), where the amount of time needed to run the completion tool string 708 into the wellbore 704 must be minimized, and where, for safety reasons, the perforating gun 710 must not be run into the wellbore 704 connected to the tool string 708.

A conventional gun hanger 712 is set in the casing 706 at a predetermined depth below the zone 702 as shown in FIG. 13A. The perforating gun 710 is lowered into the wellbore 704 on a wireline or slickline 714 and placed on the gun hanger 712. The wireline or slickline 714 is then removed from the wellbore 704.

The completion tool string 708 is then lowered into the wellbore 704 on production tubing 716. From the production tubing 716 downward the tool string 708 includes a packer 718, a positioning device 720, and a set of conventional production equipment 722.

The positioning device 720 may include devices 10, 100, or 430 shown in FIGS. 1A, 2A, or 8A, respectively. If device 430, shown in FIG. 8A, is utilized for the positioning device 720, upper tubular member 722 will correspond to inner tubular member 432 and lower tubular member 724 will correspond to outer tubular member 434.

If one of devices 10 or 100 is utilized for the positioning device 720, upper tubular member 722 of the positioning device 720 will correspond to inner tubular member 14, and lower tubular member 724 of the positioning device 720 will correspond to outer tubular member 12. Device 10 or 100, if utilized for positioning device 720 would, therefore, be vertically inverted from their configurations shown in FIGS. 1A and 2A. Additionally, if device is utilized, the ball catcher 22 should be attached to end portion 16 (see FIG. 1A). If device 100 is utilized, the ball seat 120, inner mandrel 128, and enlarged diameter 146 of sleeve 110 should be disposed within the outer tubular member 12 (see FIG. 2A).

Lower tubular member 724 is perforated as described hereinabove in the written description accompanying FIGS. 1A–1B, 2A–2B, and 8A–8B regarding outer tubular members 12 and 434. A sand control screen 726 is attached to the positioning device 720, radially overlying the perforated lower tubular member 724. Thus, fluid communication between the wellbore 704 and the interior of the tool string 708 is established by the perforated lower tubular member 724, and sand and other debris are prevented from entering the tool string 708 by the sand screen 726, after the positioning device 720 is extended.

The production equipment 722 may typically include lengths of tubing, firing heads, valves, gun releases, and other conventional items of equipment. Additionally, specialized equipment may also be used, such as tools for acidizing, fracturing, gravel packing, etc. Different items of equipment may be utilized in the production equipment 722 without departing from the principles of the present invention. In method 700 as representatively illustrated, the production equipment 722 preferably includes a conventional "head catcher", which operates to selectively latch onto and release heads, such as head 728 on perforating gun 710.

The tool string 708 is lowered into the wellbore 704 until the head catcher latches onto head 728 on the perforating gun 710. The tool string 708 is then raised until the perforating gun 710 is positioned opposite the zone 702. The packer 718 is then set, isolating the wellbore 704 below the packer from annulus 730 between the tubing 716 and the casing 706 above the packer 718.

After the packer 718 is set, the gun 710 is fired to perforate the zone 702, as shown in FIG. 13B. The gun 710 is then released from the tool string 708 and the positioning device 720 is extended to place the sand control screen 726 opposite the perforated zone 702, as shown in FIG. 13C.

Thus has been described the method 700 whereby the positioning device 720 may carry a piece of equipment, such as the sand control screen 726, and position the equipment in the wellbore 704 without requiring movement of the packer 718. The positioning device 720 in method 700 also acts as a valve to permit fluid communication between the wellbore 704 and the interior of the tool string 708 after the zone 702 has been perforated.

Figure 14A:
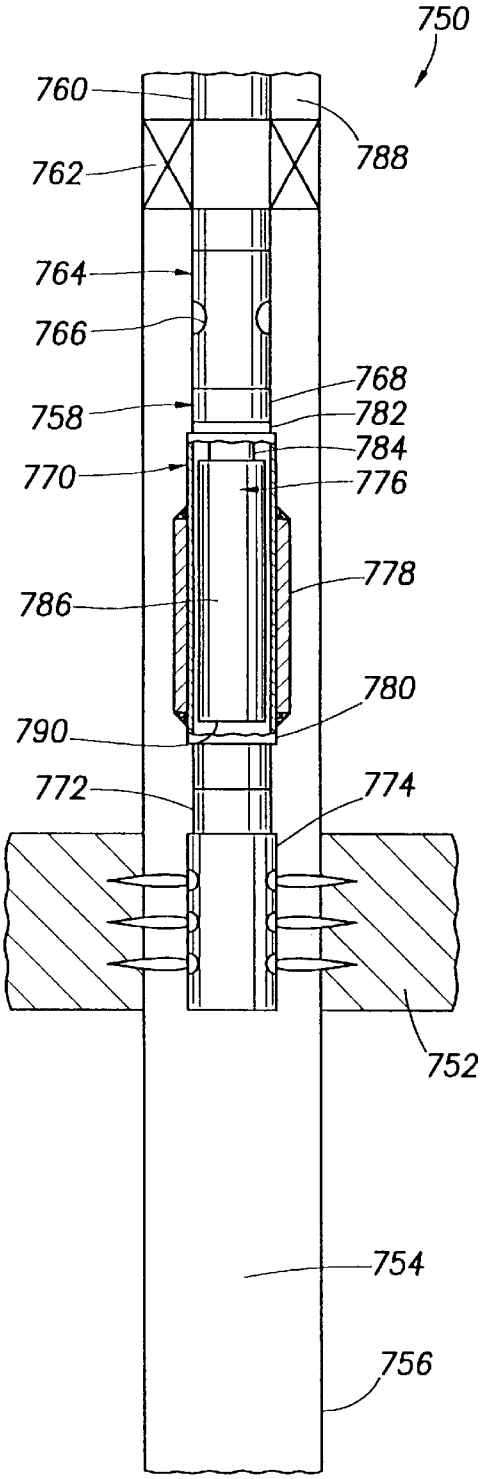
FIG. 14A is a highly schematicized partially cross-sectional view of an eighth method of completing a subterranean well, with a perforating gun positioned opposite a zone to be produced, and the zone being perforated.
Figure 14B:
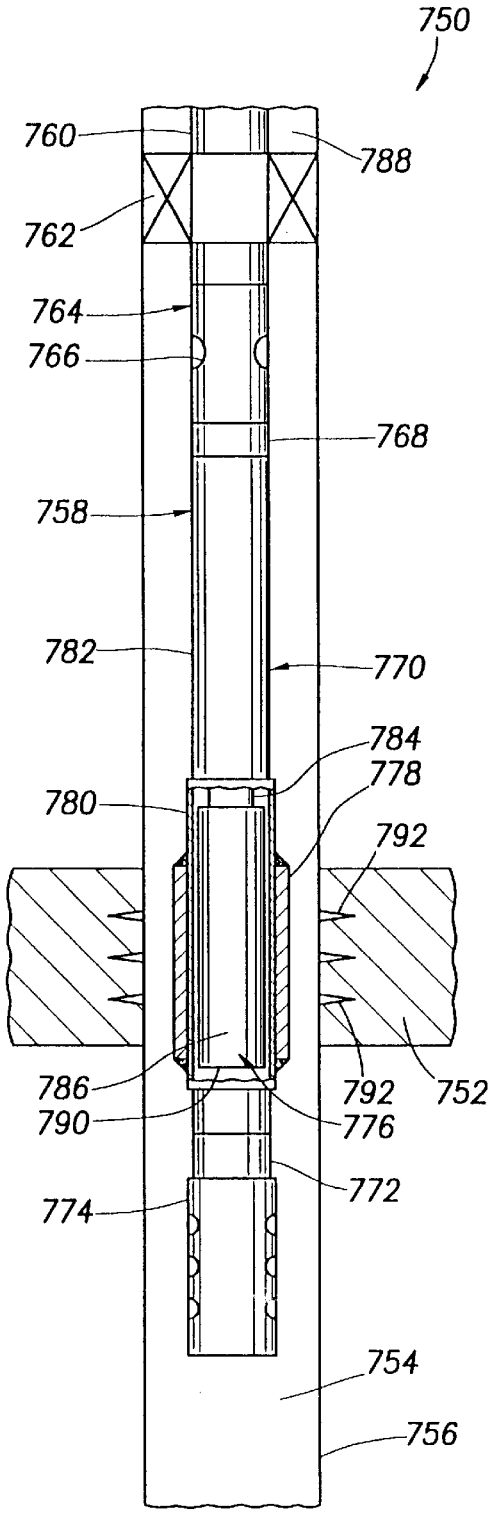
FIG. 14B is a highly schematicized partially cross-sectional view of the eighth method, with a sand control screen and washpipe positioned opposite the producing zone.

Illustrated in FIGS. 14A–14B is a method 750 of completing a subterranean well including performing a fracturing and/or gravel packing operation after perforating a zone 752. The zone 752 is intersected by a wellbore 754 which has been lined with protective casing 756. A combined perforating and fracturing/gravel packing tool string 758 is lowered into the wellbore 754 suspended from production tubing or drill pipe 760. For convenience, the following detailed description of the method 750 will refer to a gravel packing operation, but it is to be understood that a fracturing operation may also be accomplished without departing from the principles of the present invention.

The tool string 758 includes, progressing downwardly from the tubing 760, a releasable packer 762, an outer housing 764 which has ports 766 through which a gravel packing slurry may be discharged, a set of conventional gravel packing tools 768, an outer positioning device 770, a set of conventional well completion equipment 772, and a perforating gun 774. Internally disposed within the tool string 758 is an inner positioning device 776 connected to the gravel packing equipment 768.

Although the method 750 is preferably performed with the tool string 758 lowered into the wellbore 754 at one time suspended from the tubing 760, it is to be understood that portions of the tool string 758 may be lowered into the wellbore 754 separately without departing from the principles of the present invention. For example, the packer 762, outer housing 764, and outer positioning device 770 may be lowered into the wellbore 754 suspended from a wireline, the packer set in the casing 756, and then the remainder of the tool string 758 lowered into the wellbore suspended from tubing 760.

The outer positioning device 770 has a sand control screen 778 attached to lower tubular member 780 as described above in relation to positioning device 720 lower tubular member 724 representatively illustrated in FIGS. 13B and 13C. The outer positioning device 770 may include devices 10, 100, or 430 shown in FIGS. 1A, 2A, or 8A, respectively. If device 430, shown in FIG. 8A, is utilized for the outer positioning device 770, upper tubular member 782 will correspond to inner tubular member 432 and lower tubular member 780 will correspond to outer tubular member 434.

If one of devices 10 or 100 is utilized for the outer positioning device 770, upper tubular member 782 of the outer positioning device 770 will correspond to inner tubular member 14, and lower tubular member 780 of the outer positioning device 770 will correspond to outer tubular member 12. Device 10 or 100, if utilized for outer positioning device 770 would, therefore, be vertically inverted from their configurations shown in FIGS. 1A and 2A. Additionally, if device 10 is utilized, the ball catcher 22 should be attached to end portion 16 (see FIG. 1A). If device 100 is utilized, the ball seat 120, inner mandrel 128, and enlarged diameter 146 of sleeve 110 should be disposed within the outer tubular member 12 (see FIG. 2A).

Lower tubular member 780 is perforated as described hereinabove in the written description accompanying FIGS. 1A–1B, 2A–2B, and 8A–8B regarding outer tubular members 12 and 434. The sand control screen 778 is attached to the outer positioning device 770, radially overlying the perforated lower tubular member 780. Thus, fluid communication between the wellbore 754 and the interior of the tool string 758 is established by the perforated lower tubular member 780, and sand and other debris are prevented from entering the tool string 758 by the sand screen 778, after the outer positioning device 770 is extended.

The completion equipment 772 may typically include lengths of tubing, firing heads, valves, gun releases, and other conventional items of equipment. Additionally, specialized equipment may also be used, such as tools for acidizing, fracturing, gravel packing, etc. Different items of equipment may be utilized in the production equipment 772 without departing from the principles of the present invention.

Perforating gun 774 is conventional and is typically configured so that its axial length corresponds to the length of the zone 752 intersected by the wellbore 754. The perforating gun 774 may be made up of more than one individual gun sections which are joined together to achieve a desired length. It is to be understood that alternate types of perforating guns may be utilized in the representatively illustrated method 750 without departing from the principles of the present invention.

The inner positioning device 776 may include any of those devices 10, 100, 170, 240, 306, 326, and 430 shown in FIGS. 1A, 2A, 3A, 5A, 6, 7A, and 8A, respectively. If one of devices 10, 100, or 170, shown in FIGS. 1A, 2A, or 3A, respectively, is utilized for the inner positioning device 776, upper tubular member 784 of the inner positioning device 776 will correspond to outer tubular member 12, and lower tubular member 786 of the inner positioning device 776 will correspond to inner tubular member 14. If one of devices 240 or 306, shown in FIGS. 5A or 6, respectively, is utilized for the inner positioning device 776, upper tubular member 784 will correspond to outer tubular member 244 and lower tubular member 786 will correspond to inner tubular member 242. If device 326, shown in FIG. 7A, is utilized for the inner positioning device 776, upper tubular member 784 will correspond to inner tubular member 348 and lower tubular member 786 will correspond to outer tubular member 388. If device 430, shown in FIG. 8A, is utilized for the inner positioning device 776, upper tubular member 784 will correspond to inner tubular member 432 and lower tubular member 786 will correspond to outer tubular member 434.

In the method 750 representatively illustrated in FIG. 14A, the inner positioning device 776 is disposed coaxially within the upper tubular member 782 of the outer positioning device 770. In this manner, the tool string 758 is in a longitudinally compact configuration for ease of running the tool string into the wellbore 754.

The tool string 758 is lowered into the wellbore 754 until the perforating gun 774 is opposite the zone 752. The packer 762 is set in the casing 756 to isolate the wellbore 754 below the packer from the wellbore above the packer in annulus 788 between the tubing 760 and the casing 756. The gun 774 is then fired to perforate the zone 752 as shown in FIG. 14A.

The inner and outer positioning devices 776 and 770 are then extended as shown in FIG. 14B. The extension of the outer positioning device 770 permits fluid communication between the wellbore 754 and the interior of the tool string 758. Thus, fluids may flow from the wellbore 754, inwardly through the screen 778, through the perforated lower tubular member 780, and into the tool string 758.

The extension of the inner positioning device 786 provides a washpipe for flow entering the interior of the tool string 758 through the lower tubular member 780. Inner positioning device 776 is open at its lower end 790, so that fluids flowing inwardly through lower tubular member 780 may enter the inner positioning device 776 at lower end 790 and flow upwardly through lower tubular member 786, through upper tubular member 784, and to the gravel packing equipment 768.

With the zone 752 perforated and the tool string 758 configured in the manner representatively illustrated in FIG. 14B, the gravel packing slurry may then be pumped downward through the tubing 760 from the earth's surface, discharged into the wellbore 754 through ports 766, and into perforations 792. During the gravel packing operation, fluid from the slurry may be circulated back to the earth's surface via the tool string 758, the screen 778 preventing sand from entering circulation flow passageways in the gravel packing equipment 768.

Thus has been described the method 750 which enables a longitudinally compact tool string 758 to be lowered into a wellbore 754, and which enables perforating and gravel packing operations to be performed without the necessity of unsetting the packer 762. In the method 750, the inner positioning device 776 performs the function of an extendable washpipe. In addition, the method 750 utilizes multiple positioning devices 770 and 776 to both position equipment, such as the sand screen 778, on an external surface of the tool string 758, and to position equipment, such as the inner positioning device lower tubular member 786 (performing the function of a washpipe), within the tool string.

The foregoing detailed description is to be clearly understood as being given by way of illustration and example only, the spirit and scope of the present invention being limited solely by the appended claims.

What is claimed is:

1. A method of completing a subterranean well, the well having a wellbore intersecting a zone, the method comprising the steps of:

providing a first packer;

providing a positioning device, said positioning device being configured in an axially compressed configuration thereof;

attaching said positioning device to said packer;

providing a second packer;

attaching said second packer to said positioning device, such that said positioning device is axially intermediate said first packer and said second packer;

providing a perforating gun;

attaching said perforating gun to said first and second packers and said positioning device;

disposing said first and second packers, said positioning device, and said perforating gun within the wellbore;

positioning said perforating gun in the wellbore opposite the zone;

setting said first packer in the wellbore;

firing said perforating gun to perforate the zone;

actuating said positioning device to extend said positioning device to an axially extended configuration thereof;

positioning said second packer in the wellbore such that said first and second packers straddle the zone after said step of firing said perforating gun; and setting said second packer in the wellbore.

2. The method according to claim 1, wherein said step of attaching said perforating gun to said first and second packers and said positioning device further comprises attaching said perforating gun to said second packer, such that said second packer is axially intermediate said positioning device and said perforating gun.

3. The method according to claim 1, further comprising the steps of:

providing a valve; and attaching said valve to said first and second packers, said positioning device, and said perforating gun, such that said valve is axially intermediate said first and second packers.

4. The method according to claim 3, further comprising the steps of:

closing said valve before said step of setting said second packer; and opening said valve after said step of setting said second packer.

5. The method according to claim 1, wherein said step of providing said positioning device further comprises providing said positioning device comprising an outer tubular member having an inner side surface, an inner tubular member having an outer side surface, said inner tubular member being coaxially and telescopingly disposed relative to said outer tubular member, a ball catcher sealingly attached to said inner tubular member, a fastener releasably securing said inner tubular member against longitudinal movement relative to said outer tubular member, and a seal disposed intermediate said inner tubular member and said outer tubular member, said seal sealingly contacting said inner tubular member outer side surface and said outer tubular member inner side surface.

6. The method according to claim 1, wherein said step of providing said positioning device further comprises providing said positioning device comprising an outer tubular member having an inner side surface and a radially outwardly extending recess formed on said outer tubular member inner side surface, an inner tubular member coaxially and telescopingly disposed relative to said outer tubular member, a lug having inner and outer side surfaces, said lug being attached to said inner tubular member, said lug further being aligned with said recess and configured for radial movement relative to said recess, said lug outer side surface being received in said recess, a tubular sleeve disposed radially inwardly relative to said lug and laterally aligned with said lug, said tubular sleeve having an outer side surface, said tubular sleeve outer side surface contacting said lug inner side surface, a radially expandable ball seat, and first and second fasteners, said first fastener releasably securing said ball seat against movement relative to said tubular sleeve, and said second fastener releasably securing said tubular sleeve against movement relative to said lug.

7. The method according to claim 1, wherein said step of providing said positioning device further comprises providing said positioning device comprising an outer tubular member having an inner side surface, an inner tubular member having inner and outer side surfaces, said inner tubular member being coaxially and telescopingly disposed relative to said outer tubular member, a first seal, said first seal sealingly engaging said inner tubular member outer side surface and said outer tubular member inner side surface, a chamber disposed radially intermediate said outer tubular member inner side surface and said inner tubular member outer side surface, a hollow plug having a closed end extending therefrom, said plug being in fluid communication with said chamber, a tubular sleeve disposed radially inwardly relative to said plug and longitudinally aligned with said plug, said tubular sleeve having an outer side surface, a second seal, said second seal sealingly engaging said outer side surface of said tubular sleeve and said inner side surface of said inner tubular member, a radially expandable ball seat, and a fastener, said fastener releasably securing said ball seat against movement relative to said tubular sleeve.

8. The method according to claim 1, wherein said step of providing said positioning device further comprises providing said positioning device comprising an outer tubular member having an inner side surface, an inner tubular member having an outer side surface, said inner tubular member being coaxially and telescopingly disposed relative to said outer tubular member, first and second longitudinally spaced apart seals, each of said first and second seals sealingly engaging said inner tubular member outer side surface and said outer tubular member inner side surface, a chamber disposed radially intermediate said outer tubular member inner side surface and said inner tubular member outer side surface, a hollow plug having a closed end extending therefrom, said plug being in fluid communication with said chamber, a tubular sleeve disposed radially inwardly relative to said plug and longitudinally aligned with said plug, and a ball seat, said ball seat being releasably secured against movement relative to said inner tubular member by said plug.

9. The method according to claim 1, wherein said step of providing said positioning device further comprises providing said positioning device comprising an outer tubular member having an inner side surface, an inner tubular member having an outer side surface, said inner tubular member being coaxially and telescopingly disposed relative to said outer tubular member, a first seal, said first seal sealingly engaging said inner tubular member outer side surface and said outer tubular member inner side surface, a chamber disposed radially intermediate said outer tubular member inner side surface and said inner tubular member outer side surface, a hollow plug having a closed end extending therefrom, said plug being in fluid communication with said chamber, a tubular sleeve disposed radially inwardly relative to said plug and longitudinally aligned with said plug, said tubular sleeve having an inner side surface and a shifting tool engagement profile formed on said tubular sleeve inner side surface, said tubular sleeve being releasably secured against movement relative to said plug by said plug, and a second seal longitudinally spaced apart from said first seal, said second seal sealingly engaging said outer side surface of said inner tubular member and said inner side surface of said outer tubular member.

10. The method according to claim 1, wherein said step of providing said positioning device further comprises providing said positioning device comprising an outer tubular member having an inner side surface, said outer tubular member inner side surface having a radially enlarged portion disposed longitudinally intermediate first and second longitudinally spaced apart radially reduced portions formed on said outer tubular member inner side surface, an inner tubular member having an outer side surface, said inner tubular member being coaxially and telescopingly disposed relative to said outer tubular member, said inner tubular member outer side surface having a radially enlarged portion formed thereon, and said inner tubular member outer side surface radially enlarged portion being disposed longitudinally intermediate said outer tubular member inner side surface first and second radially reduced portions, a chamber disposed radially intermediate said inner tubular member outer side surface and said outer tubular member inner side surface, an opening, said opening being in fluid communication with said chamber, a first seal sealingly engaging said outer tubular member inner side surface first radially reduced portion and said inner tubular member outer side surface, a second seal sealingly engaging said inner tubular member outer side surface radially enlarged portion and said outer tubular member inner side surface, and an actuating member having an upper portion, said upper portion being longitudinally aligned with and opposite said opening.

11. The method according to claim 1, wherein said step of providing said positioning device further comprises providing said positioning device comprising an outer tubular member having an inner side surface, said outer tubular member inner side surface having a radially enlarged portion and longitudinally spaced apart first and second radially reduced portions formed thereon, said outer tubular member inner side surface radially enlarged portion being disposed intermediate said outer tubular member inner side surface first and second radially reduced portions, an inner tubular member having an outer side surface, said inner tubular member being coaxially and telescopingly disposed relative to said outer tubular member, said inner tubular member outer side surface having a radially enlarged portion and longitudinally spaced apart first and second radially reduced portions formed thereon, said inner tubular member outer side surface radially enlarged portion being disposed intermediate said inner tubular member outer side surface first and second radially reduced portions, a first seal, said first seal sealingly engaging said inner tubular member outer side surface radially enlarged portion and said outer tubular member inner side surface radially enlarged portion, a second seal, said second seal sealingly engaging said inner tubular member outer side surface second radially reduced portion and said outer tubular member inner side surface second radially reduced portion, a chamber disposed radially intermediate said outer tubular member inner side surface radially enlarged portion and said inner tubular member outer side surface second radially reduced portion, an opening, said opening being in fluid communication with said chamber, a tubular sleeve disposed radially inwardly relative to said opening and longitudinally aligned with said opening, said tubular sleeve having inner and outer side surfaces and a shifting tool engagement profile formed on said tubular sleeve inner side surface, third and fourth longitudinally spaced apart seals, each of said third and fourth seals sealingly engaging said tubular sleeve outer side surface, and said third and fourth seals longitudinally straddling said opening, and a fastener releasably securing said tubular member against movement relative to said opening.

12. A method of completing a subterranean well, the well having a wellbore intersecting a zone, the method comprising the steps of:

positioning a tubular string in the well, the string including a positioning device, and first and second packers;

setting the first packer in the wellbore on one side of the zone;

then actuating the positioning device, thereby elongating the positioning device and positioning the second packer on the other side of the zone without unsetting the first packer; and then setting the second packer in the wellbore on the other side of the zone.

13. The method according to claim 12, wherein in the tubular string positioning step, the tubular string further includes a perforating gun, and wherein in the first packer setting step, the perforating gun is positioned opposite the zone when the first packer is set in the wellbore.

14. The method according to claim 13, wherein in the tubular string positioning step, the second packer is positioned in the string between the first packer and the perforating gun.

15. The method according to claim 12, wherein in the actuating step, the second packer is displaced from the one side of the zone to the other side of the zone in the wellbore.

16. The method according to claim 12, wherein in the first packer setting step the positioning device is in an axially compressed configuration thereof, wherein in the actuating step the positioning device is elongated from the axially compressed configuration to an axially extended configuration thereof, and wherein in the second packer setting step the positioning device is in the axially extended configuration.

* * * * *